US007445586B2

(12) United States Patent
Gibson

(10) Patent No.: US 7,445,586 B2
(45) Date of Patent: Nov. 4, 2008

(54) COMBINATION CHAIR AND LEG EXTENSION APPARATUS FOR OBESITY PROPHYLAXIS

(76) Inventor: John Gibson, 22 Moulton Aiken Road, RR #6, Dunnville, Ontario (CA) N1A 2W5

( * ) Notice: Subject to any disclaimer, the term of this patent is extended or adjusted under 35 U.S.C. 154(b) by 9 days.

(21) Appl. No.: 11/279,195

(22) Filed: Apr. 10, 2006

(65) Prior Publication Data

US 2006/0255643 A1 Nov. 16, 2006

Related U.S. Application Data

(60) Provisional application No. 60/671,525, filed on Apr. 15, 2005.

(51) Int. Cl.
*A63B 26/00* (2006.01)

(52) U.S. Cl. ..... 482/142; 482/148

(58) Field of Classification Search ..... 297/423.4; 482/148

See application file for complete search history.

(56) References Cited

U.S. PATENT DOCUMENTS

| | | | |
|---|---|---|---|
| 3,369,403 | A | 2/1968 | Carlin et al. |
| 3,387,843 | A | 6/1968 | Chandler |
| 3,524,644 | A | 8/1970 | Kane |
| 3,580,224 | A | 5/1971 | Graves |
| 3,589,715 | A | 6/1971 | Mark et al. |
| 3,640,529 | A | 2/1972 | Kane |
| 3,738,649 | A | 6/1973 | Miller |
| 3,794,397 | A | 2/1974 | Flototto |
| 3,825,252 | A | 7/1974 | Geiger |
| 3,848,607 | A | 11/1974 | St. Clari |
| 3,851,874 | A | 12/1974 | Wilkin |
| 3,861,384 | A | 1/1975 | Casternovia |
| 3,916,537 | A | 11/1975 | Gilligan et al. |
| 3,976,057 | A | 8/1976 | Barclay |
| 4,013,287 | A | 3/1977 | Dickman |
| 4,026,548 | A | 5/1977 | Birdwell |
| 4,059,265 | A | 11/1977 | Wieder et al. |
| 4,147,344 | A | 4/1979 | Lee |
| D254,143 | S | 2/1980 | de Bock |
| 4,214,577 | A | 7/1980 | Hoy |
| 4,243,219 | A | 1/1981 | Price |
| D262,490 | S | 12/1981 | Hewitt |

(Continued)

FOREIGN PATENT DOCUMENTS

| | | |
|---|---|---|
| DE | 4 437 160 | 4/1996 |

(Continued)

OTHER PUBLICATIONS

Life Personal Sym 4637: available at http://www.hsionline.com/products/ecbuilder2/item5082.htm.

(Continued)

*Primary Examiner*—Lori Amerson
(74) *Attorney, Agent, or Firm*—Patterson & Sheridan, LLP

(57) ABSTRACT

A combination chair and leg extension apparatus is provided. The apparatus uses a pneumatic source of resistence to provide a stowable flexor for the leg muscles which remains connected to the chair. Variations of the combination also provide for a combination desk, chair and leg extension apparatus, and a combination office chair and leg extension apparatus. The invention is to assist in prevention of obesity, particularly in children.

17 Claims, 24 Drawing Sheets

U.S. PATENT DOCUMENTS 4,304,401 A 12/1981 Goodman
4,364,559 A 12/1982 Valentine
4,371,161 A 2/1983 Williams
4,384,715 A 5/1983 Savio et al.
4,389,070 A * 6/1983 Chien ..... 297/365
4,426,077 A 1/1984 Becker
4,466,613 A 8/1984 Reese
4,468,026 A 8/1984 Roark
4,483,533 A 11/1984 Mangiapane
4,492,376 A 1/1985 Schatz et al.
4,575,097 A 3/1986 Brannigan et al.
4,601,464 A 7/1986 Mousel
4,609,190 A * 9/1986 Brentham ..... 482/8
4,623,267 A 11/1986 White
4,627,662 A 12/1986 Carter et al.
4,685,671 A 8/1987 Hagermann et al.
4,712,539 A 12/1987 Kim
4,749,189 A 6/1988 Frank
4,753,241 A 6/1988 Brannigan et al.
4,784,121 A 11/1988 Brooks
4,804,180 A 2/1989 Salaz
4,805,601 A 2/1989 Eischen, Sr.
4,805,901 A * 2/1989 Kulick ..... 482/63
4,848,357 A 7/1989 Wong et al.
4,913,423 A 4/1990 Farran et al.
4,943,051 A 7/1990 Haskins et al.
4,974,840 A * 12/1990 Welch ..... 482/133
D313,515 S 1/1991 Wood
5,002,271 A 3/1991 Gonzales
5,005,831 A 4/1991 Hara
5,020,795 A 6/1991 Airy et al.
5,038,761 A 8/1991 Richardson
5,042,799 A 8/1991 Stanley
5,044,633 A 9/1991 Rice
5,071,116 A 12/1991 Minear
5,100,129 A 3/1992 Porter et al.
5,107,775 A 4/1992 Langlais et al.
5,109,832 A 5/1992 Proctor et al.
5,176,602 A 1/1993 Roberts
5,178,598 A 1/1993 Finch
5,234,394 A 8/1993 Wilkinson
D341,040 S 11/1993 Maffei
5,299,861 A 4/1994 Foliot et al.
5,324,243 A 6/1994 Wilkinson
5,324,246 A 6/1994 Wang
5,431,624 A 7/1995 Saxton et al.
5,470,298 A * 11/1995 Curtis ..... 482/130
5,486,149 A 1/1996 Smith et al.
5,499,958 A 3/1996 Hess
5,522,783 A 6/1996 Gordon
5,547,442 A 8/1996 Carballosa et al.
5,569,122 A 10/1996 Cegla
5,569,138 A 10/1996 Wang et al.
5,599,260 A 2/1997 Rovinsky et al.
5,611,761 A 3/1997 Brown
5,639,810 A 6/1997 Smith, III et al.
5,645,516 A 7/1997 Foster
5,669,863 A 9/1997 Ho
5,690,594 A 11/1997 Mankovitz
5,735,218 A 4/1998 Fewchuk
5,785,635 A 7/1998 Gerschefske et al.
5,800,443 A 9/1998 Shah
5,807,211 A 9/1998 Berryhill
5,807,212 A 9/1998 Nelson
5,820,532 A 10/1998 Oliver
5,823,120 A 10/1998 Holmquist
5,823,976 A 10/1998 Cain et al.
5,833,575 A * 11/1998 Holslag ..... 482/51
5,860,697 A 1/1999 Fewchuk
5,890,438 A 4/1999 Frankish
5,921,900 A 7/1999 Mankovitz
5,950,626 A 9/1999 Wagener et al.
5,993,361 A 11/1999 Paoli et al.
6,010,430 A 1/2000 Mankovtiz
6,010,434 A 1/2000 Hodges
6,021,722 A 2/2000 Raycraft
6,045,486 A 4/2000 Jensen
6,050,920 A 4/2000 Ehrenfried
D425,949 S 5/2000 Sandoval
6,056,675 A 5/2000 Aruin et al.
6,059,819 A 5/2000 Weder
6,099,445 A 8/2000 Rovinsky et al.
6,117,055 A 9/2000 Boland
6,117,056 A 9/2000 Cataldi, Jr. et al.
6,152,865 A 11/2000 Beauvoir
6,165,110 A 12/2000 Gajda
6,203,101 B1 3/2001 Chou et al.
6,251,123 B1 6/2001 Patner
6,283,549 B1 9/2001 Husemann
6,286,463 B1 9/2001 Sykes
6,306,067 B1 10/2001 Gizas
6,350,246 B1 2/2002 DeToro et al.
6,461,377 B1 10/2002 An
6,544,219 B2 4/2003 Happ et al.
6,556,872 B2 4/2003 Hauck
6,560,489 B2 5/2003 Hauck
6,565,493 B1 5/2003 Geh
6,637,072 B2 10/2003 Footitt et al.
6,948,775 B2 9/2005 Tsai
7,040,693 B1 5/2006 Dorner et al.
7,128,700 B2 * 10/2006 Wallach ..... 482/130

FOREIGN PATENT DOCUMENTS

GB 2 415 149 12/2005
WO WO 2006/031372 3/2006

OTHER PUBLICATIONS

"Cycle Your Way To Daily Fitness" available at www.skymall.com or 1-800-SKYMALL.
"A Strengthening Tool For Home Or Office Use" Advertisement in Health & Fitness.
http:www.hsionline.com/products/ecbuilder2/item5082.htm, Life Personal Gym 4637b.
Flag House, Home-Model Restorator, p. 80.
www.skymall.com, Cycle your way to daily fitness, p. 147.
Health & Fitness, "Dorsi-Flex Lower Body Exerciser", p. 119.

* cited by examiner

COMBINATION CHAIR AND LEG EXTENSION APPARATUS FOR OBESITY PROPHYLAXIS

CROSS-REFERENCE TO RELATED APPLICATIONS

This application claims benefit of U.S. provisional patent application Ser. No. 60/671,525, filed Apr. 15, 2005, which is herein incorporated by reference.

FIELD OF THE INVENTION

The invention relates to chairs and, more particularly, to chairs permitting seated leg flexion for muscle development.

BACKGROUND OF THE INVENTION

There is a growing awareness of obesity and the human health problems it causes. In order to address this problem, there seems to be general agreement that a proper diet and a variety of physical activities are needed.

In order to attack this problem at its origin, there is an increasing recognition that the physical activity habits of children are key. Growing children need to develop and utilize their muscles.

We do not exist in a culture that lends itself to physical activity. The modern lifestyle is founded on and depends upon transportation, which has eliminated most physical activities and duties.

Children are not exempt from this new sedentary lifestyle. To take a typical example, a student, after an evening of sedentary T.V., telephone and computer involvement, rises in the morning, either walks or is driven a minimal distance to a bus stop where he then begins another sedentary day. The student may sit on a bus one or more hours per day on his way to and from school. At school, the majority of the student's day will be sedentary, twenty five to thirty hours per week.

Taking the example of a child's leg muscles, routine muscle development and conditioning are critical to the physical development of growing children. The leg flexor muscles that a child naturally develops as an infant, as he struggles to get on his feet and then become stable, then walking and running, through the five or so infancy years until he reaches school age, must continue to develop and progress. The leg flexor muscle development must be allowed to continue when and after a child takes his first steps onto a school bus, as he begins a sedentary lifestyle.

In most households, expensive equipment, like treadmills and stationary bicycles, just sit there; either broke down or used for hanging laundry. This is because one of the most difficult things to do is to exercise for the sake of exercising.

Obesity is not likely to be addressed by voluntary physical activity, unless it is easy for humans to do, habitual and natural. If human beings do not have to move, they will not. If children start out their lives with sedentary habits and patterns, they will not have the capacity to move when they reach adulthood.

SUMMARY OF THE INVENTION

In order to address the above problems, a combination device is provided that combines the "sedentary" aspect of a chair with a leg-strengthening apparatus. The invention provides a combination chair and leg extension apparatus.

This may be installed in both schools (for student seating) as well as on office chairs so that adults will be able to keep the program going forward. In addition, it is expected that the invention would be beneficial on any kind of stationary seating, in various locations and arrangements, including hospitals, homes, aircrafts, ships, bouts, trains, buses, restaurants, waiting rooms, in the space station—anywhere that people sit for periods of time. Similar devices may even be considered "safety equipment" and may be mandated in line with other safety requirements presently prescribed (safety belts in cars, child car seats, hard hats and steel toed shoes in certain building environments, etc.).

It is believed that the combination chair and leg-extension apparatus will provide a convenient and accessible means of developing and strengthening the leg muscles, and thus act as a catalyst that will incite human beings to be physically active.

According to a first embodiment, a combination chair and leg extension apparatus is provided. The chair has a generally L-shaped frame on which is disposed a seat portion and a back portion. Below the frame, a base portion with legs extends to the floor. The seat portion has a top surface for sitting and a bottom surface opposed to the top surface. A recline means is provided, which is disposed between the frame and the base portion to permit selective pivoting of the frame into a reclined position in which a front edge of the frame is spaced away from the base. A leg extension apparatus is attached to the chair. The apparatus has a telescoping tube member mounted in a longitudinal orientation on the bottom surface of the seat portion. The tube has at least two segments concentrically arranged for telescopic movement in relation to each other. The apparatus also has a flexor leg pivotally mounted to the front end of the tube which terminates in a pair of foot stirrups. The apparatus also has a pneumatic resistor connecting the flexor leg to the back end of the tube.

The apparatus permits a user seated in the chair to engage the stirrups with the user's feet and, using the force of the user's leg strength to overcome the resistence provided by the resistor, the user can kick the flexor leg forward in an arc, thereby drawing forward the tube to fully extend the flexor leg and the tube forwardly away from the chair. When not in use, the flexor leg can be positioned under the chair and the tube compressed for stowing the apparatus under the chair in a stowed position.

It is preferred that the arc described by the stirrup end of the flexor leg does not touch the floor at any point. Furthermore, it is preferred that the arc described by the stirrup end of the flexor leg does not touch any portion of the chair. Clearing the floor is also preferably facilitated by the recline means.

For safe and compact storage, it is preferred that the apparatus in stowed position does not extend in any direction beyond the outer dimensions of the chair. Alternatively, the apparatus may be designed to fit within the dimensions established by an area bounded by the legs of the chair.

According to a second embodiment, a combination desk, chair and leg extension apparatus is provided. The combination desk and chair has a generally U-shaped frame on which is disposed at one end a desk platform, and at the other end a chair. The chair itself has a generally L-shaped frame on which is disposed a seat portion and a back portion, and a base portion connected to the U-shaped frame. The seat portion has a top surface for sitting and a bottom surface opposed to the top surface.

A leg extension apparatus is attached to the chair. The leg extension apparatus has a telescoping tube member, which is mounted in a longitudinal orientation on the bottom surface of the seat portion. The tube has at least two segments concentrically arranged for telescopic movement in relation to each other, having a front end disposed toward the front of the chair and a back end disposed toward the back of the chair. The apparatus also has a flexor leg pivotally mounted to the front end of the tube, which terminates in a pair of foot stirrups. The apparatus also has a pneumatic resistor connecting the flexor leg to the back end of the tube.

The apparatus permits a user seated in the chair to engage the stirrups with the user's feet and, using the force of the user's leg strength to overcome the resistence provided by the resistor, the user can kick the flexor leg forward in an arc, thereby drawing forward the tube to fully extend the flexor leg and tube forwardly away from the chair.

In one variation, the desk platform may be adjustable to raise or lower the height.

In another variation, the U-shaped frame may be adjustable to vary the space between the chair and the desk to permit standing between the chair and the desk.

According to a third embodiment, a combination office chair and leg extension apparatus is provided. The office chair has a generally L-shaped frame on which is disposed a seat portion a back portion and two arm rests, and a pedestal base portion extending below the frame to the floor. The pedestal base portion is height adjustable to vary the distance between the frame and the floor.

The combination also includes a leg extension apparatus with two leg extension assemblies. Each assembly is attached to an arm rest of the chair. Each assembly has a flexor leg pivotally mounted to the arm rest. Each assembly also has a telescoping tube member connected to and extending beyond the flexor leg, having at least two segments concentrically arranged for telescopic movement in relation to each other, and terminating in a pair of foot stirrups. Each assembly also has a pneumatic resistor connecting the flexor leg to a back end of the arm rest.

The apparatus permits a user seated in the chair to pivot forward the apparatus from the stowed position and to engage the stirrups with the user's feet. Using the force of the user's leg strength to overcome the resistence provided by the resistor, the user can kick the flexor leg forward in an arc, thereby drawing forward the tube to fully extend the flexor leg and tube forwardly away from the chair.

The office chair may be further provided with a recline means disposed between the frame and the base portion to permit selective pivoting of the frame into a reclined position in which a front edge of the frame is spaced away from the base.

The recline may provide additional clearance to keep the apparatus off the floor as it sweeps in its arc. The height adjustability of the pedestal base may also permit additional clearance between the arc described by the apparatus and the floor. Preferably, the leg extension apparatus does not touch the floor at any point. Preferably, the apparatus does not touch the pedestal base at any point.

BRIEF DESCRIPTION OF THE DRAWINGS

Drawings of various embodiments of the invention, and portions thereof, are provided herewith. Three main embodiments of the invention are illustrated:

a first embodiment (combination chair and leg-extension apparatus) shown in FIGS. 1-23;

a second embodiment (combination chair, desk and leg-extension apparatus) shown in FIGS. 24-28; and a third embodiment (combination office chair and leg-extension apparatus) shown in FIGS. 29-34.

Figure 1:
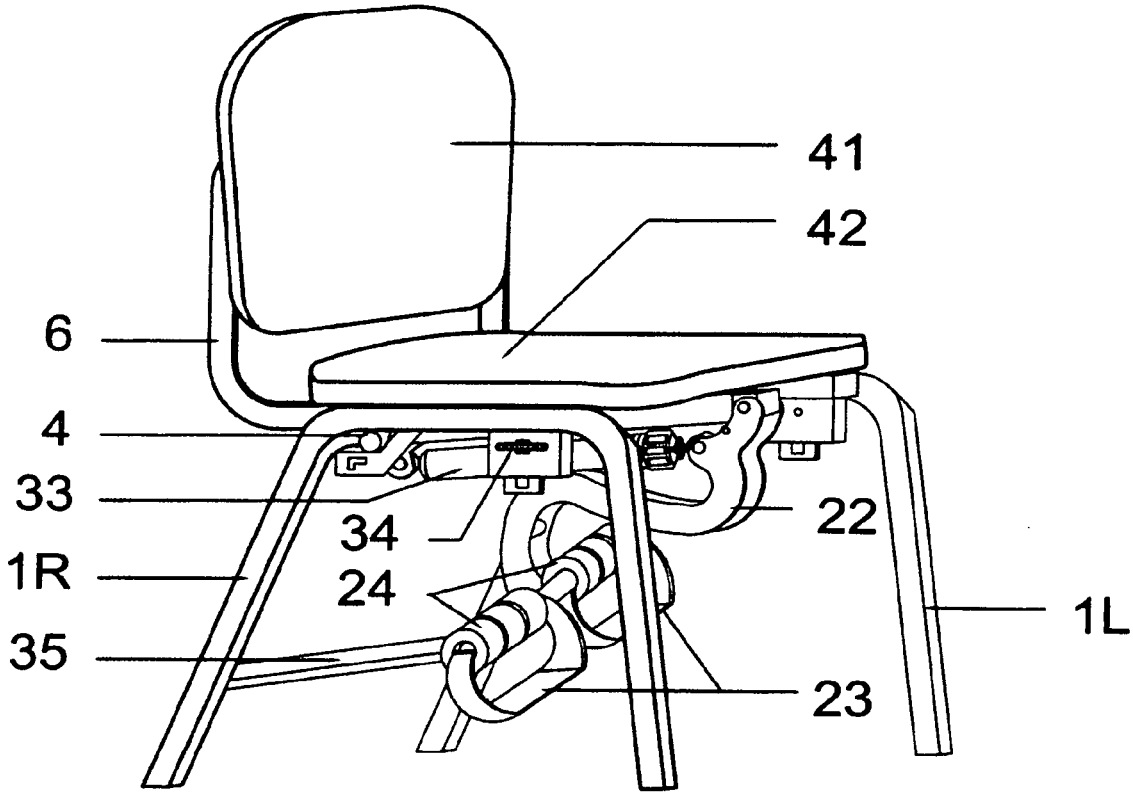

FIG. 1 is a schematic view showing a seating article according to the first embodiment in a stowed position.

Figure 2:
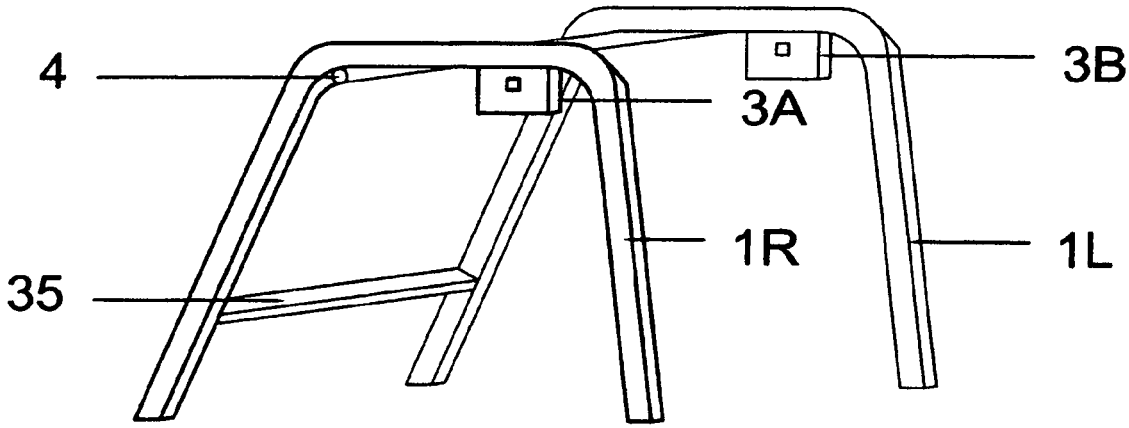

FIG. 2 is a perspective view showing the lower leg frame of the first embodiment.

Figure 3:
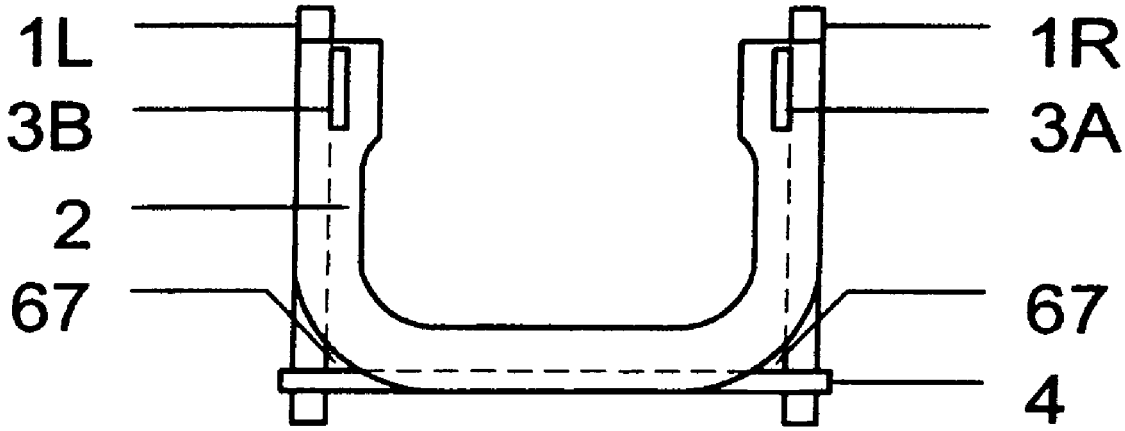

FIG. 3 is a perspective top view of the leg base frame stabilizing horseshoe web rear roll bar and holding block in accordance with the first embodiment.

Figure 4:
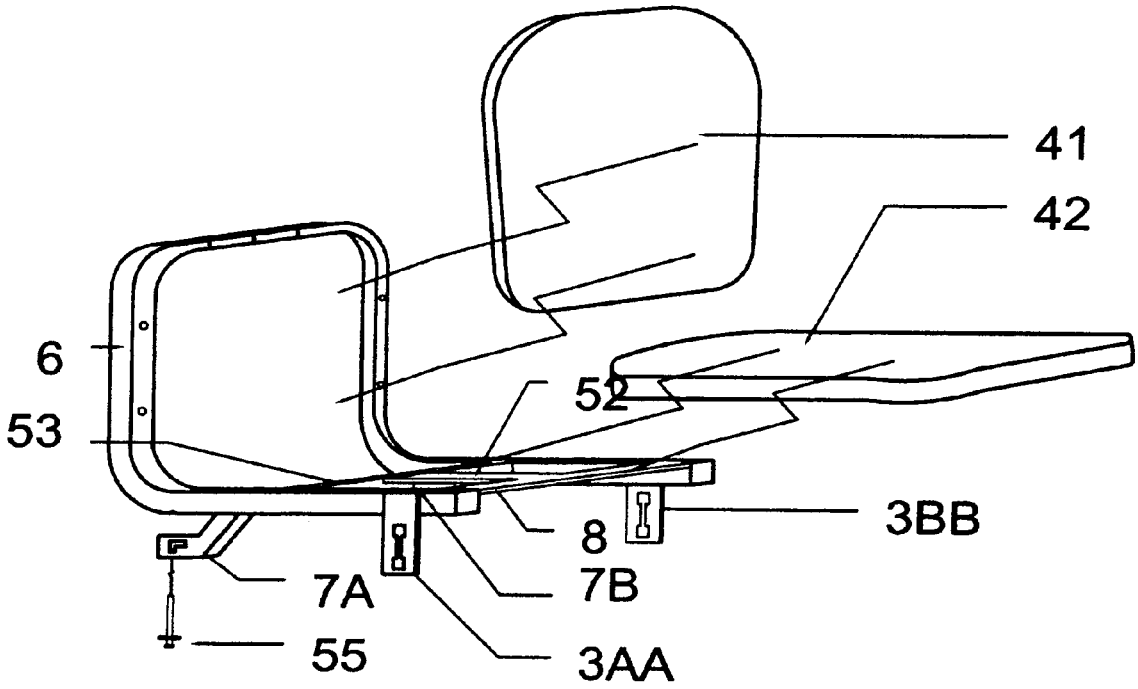

FIG. 4 is schematic view of the seat frame showing cross framing, seat and back of the first embodiment.

Figure 5:
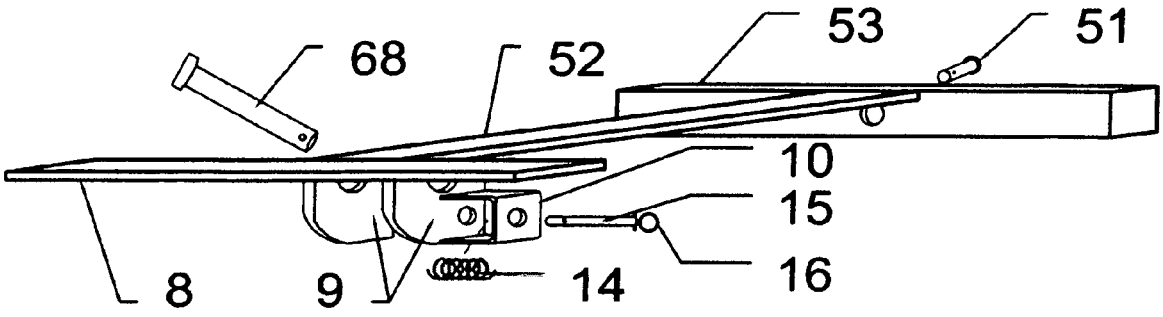

FIG. 5 is a sectional view of the under seat attaching mechanism and cross frame of the first embodiment.

Figure 6:
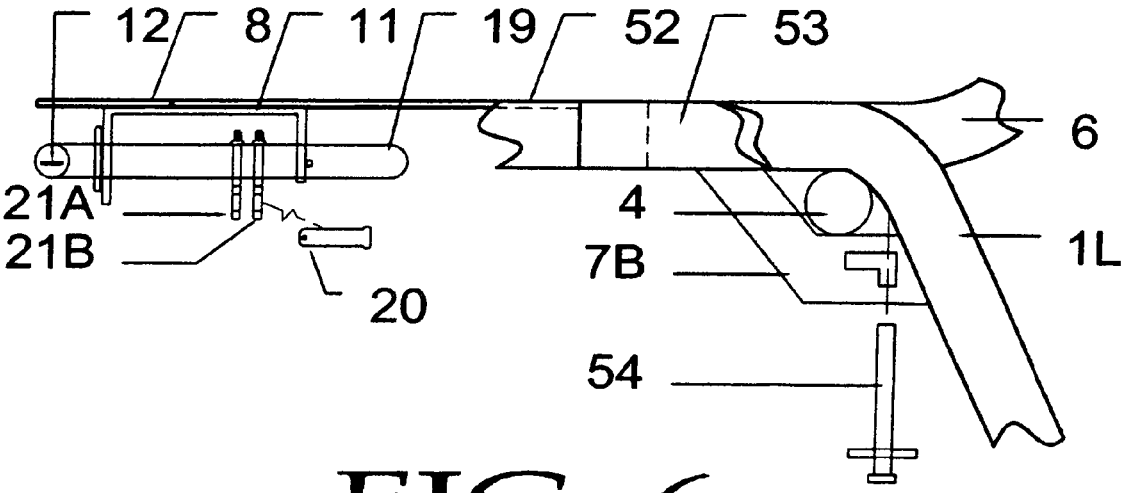

FIG. 6 is a section view of the under seat rear attachment mechanism of the first embodiment.

Figure 7:
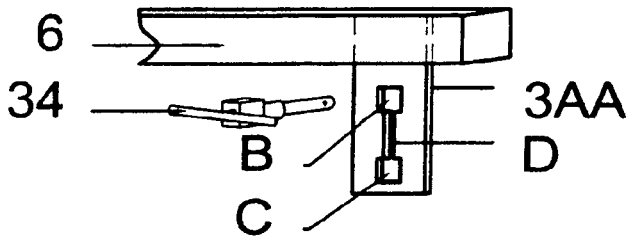

FIG. 7 is a sectional side view of the under seat tilt inner holding mechanism of the first embodiment.

Figure 8:
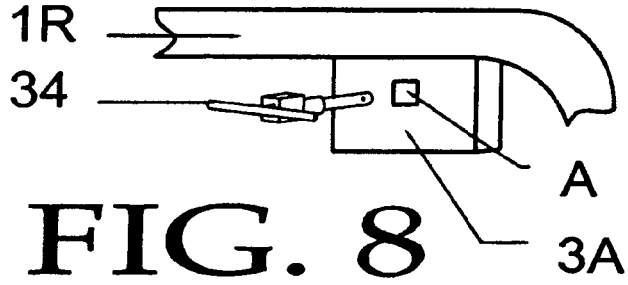

FIG. 8 is a sectional side view of the under seat front holding block showing square pin hole and pin of the first embodiment.

Figure 9:
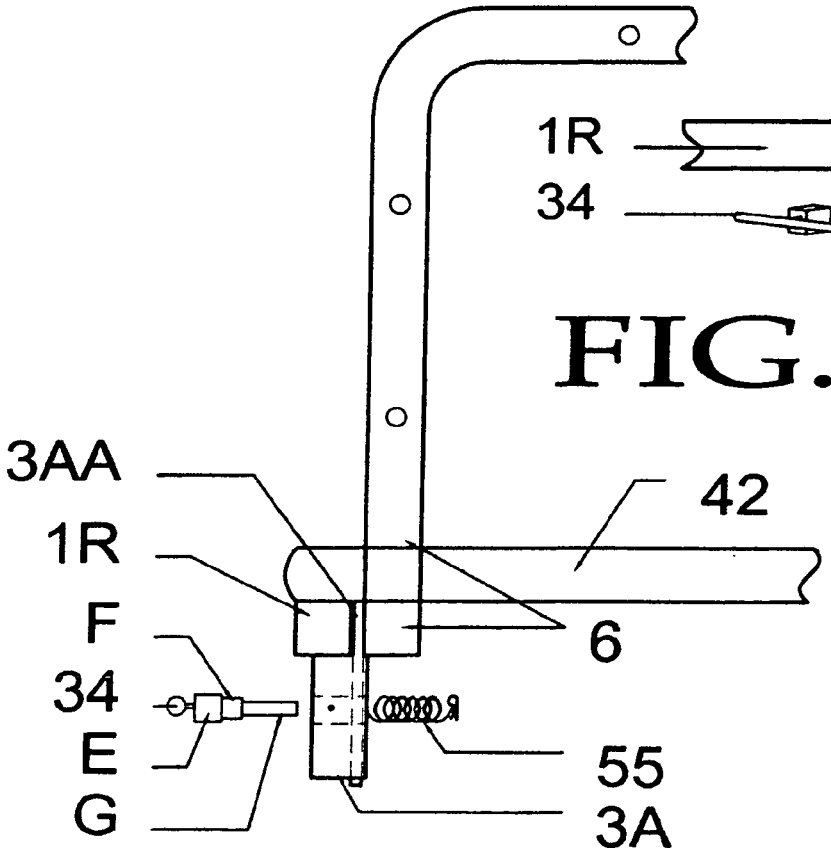

FIG. 9 is a sectional front view of the chair frame, holding block and inner holding mechanism in the lower stowed position showing holding pin and compression spring of the first embodiment.

Figure 10:
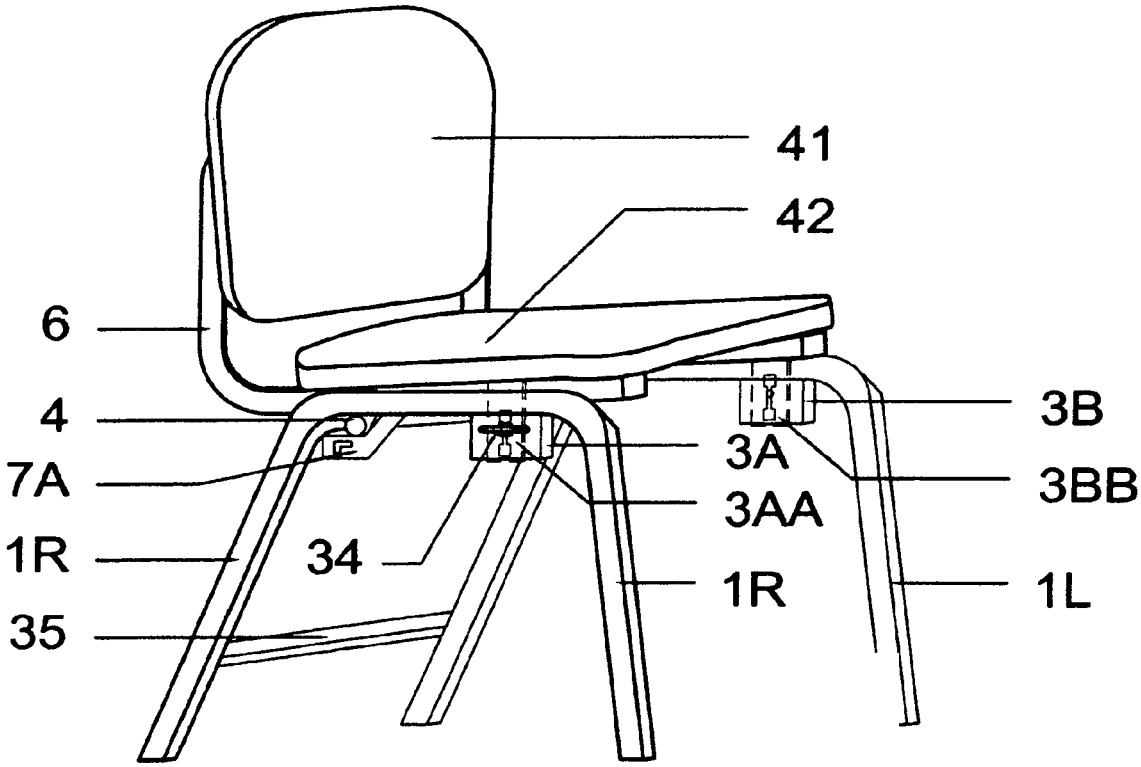

FIG. 10 is a schematic view of the chair only disposing the tilting point of the ten degree incline angle of the seat of the invention in accordance with the first embodiment.

Figure 11:
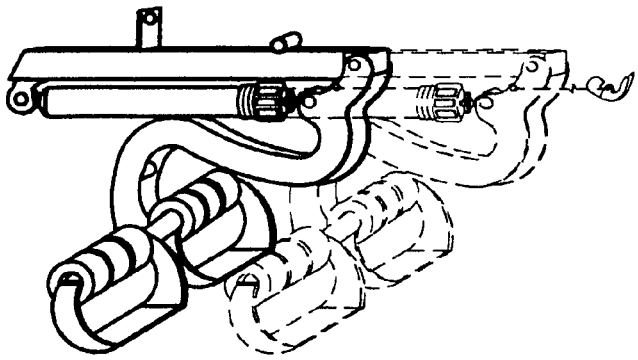

FIG. 11 is a schematic side view of the pneumatic flexor leg with holding clip holding the flexor leg in the stowed position of the first embodiment.

Figure 12:
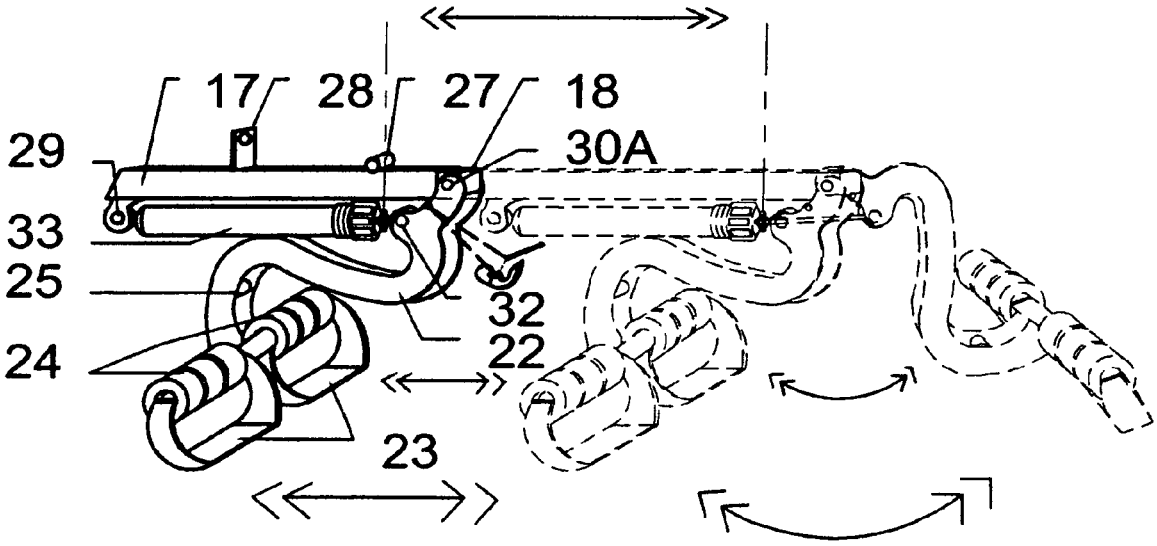

FIG. 12 is a schematic side view of the pneumatic flexor leg in a forward extended position simulating an oscillating motion in accordance with the first embodiment FIGS. 13, 14, 15, 16 are views of parts of the square tube according to the first embodiment.

Figure 13:
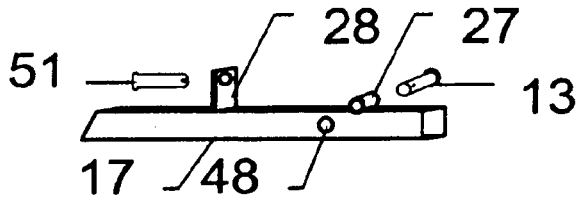

FIG. 13 is a side view of the stationary outer square tube.

Figure 14:
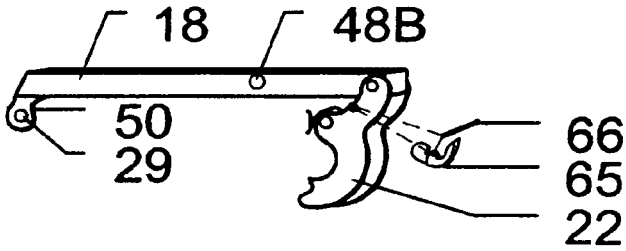
Figure 15:
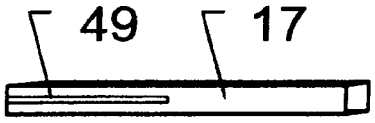

FIG. 14 is a side view of the inner square tube, showing a partial view of the flexor attached, FIG. 15 is a bottom view of the outer square tube.

Figure 16:
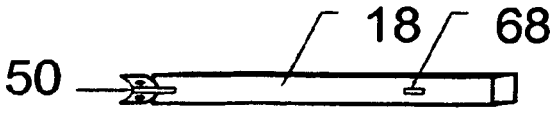

FIG. 16 is a bottom view of the inner square tube.

Figure 17:
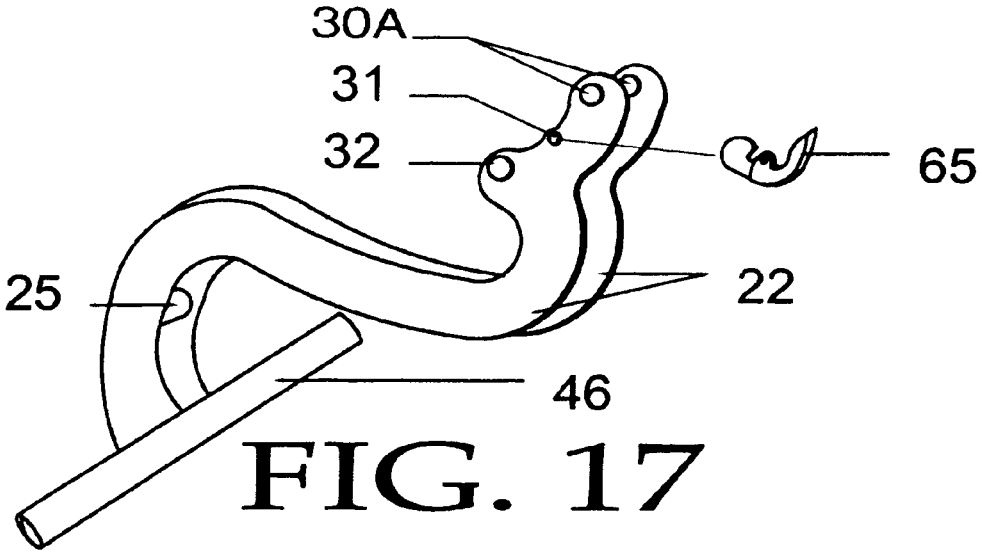

FIG. 17 is a side view of the flexor leg, with the lower foot roll pad bar, stow-away showing the holding clip and pin holes according to the first embodiment.

Figure 18:
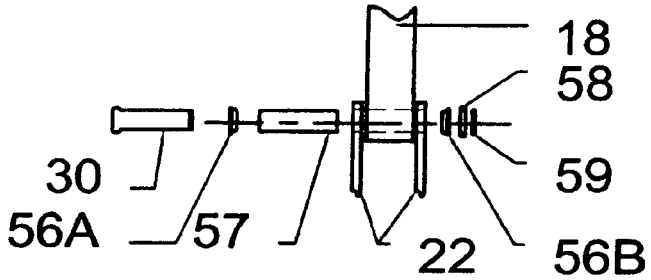

FIG. 18 is a top view of the inner tube attachment to the flexor leg.

Figure 19:
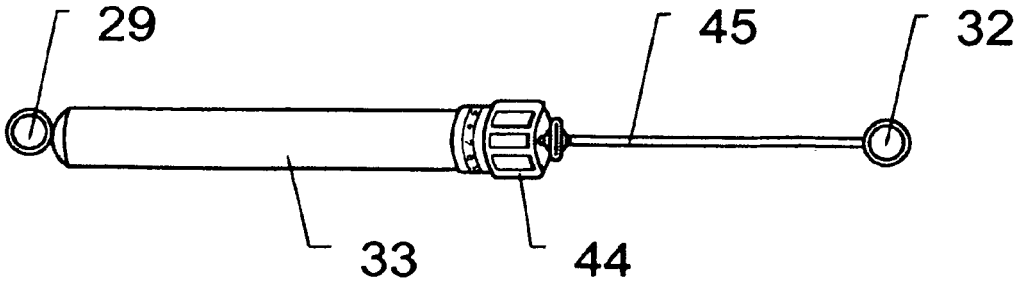

FIG. 19 is a side view the pneumatic shock absorber extended in accordance with the first embodiment.

Figure 20:
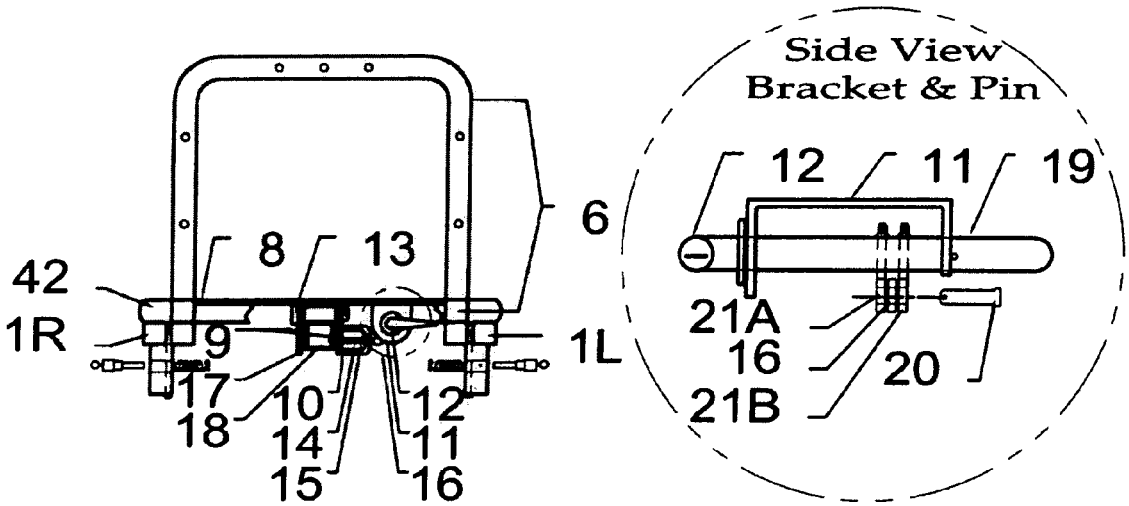

FIG. 20 is a front view showing the chair back frame, front holding block, outer tube holding brackets, outer and inner tubes with spring pin and harness bracket, with an exploded sectional side view showing a bracket lever pin with limiting washing twin eyelets and pin of the first embodiment.

Figure 21:
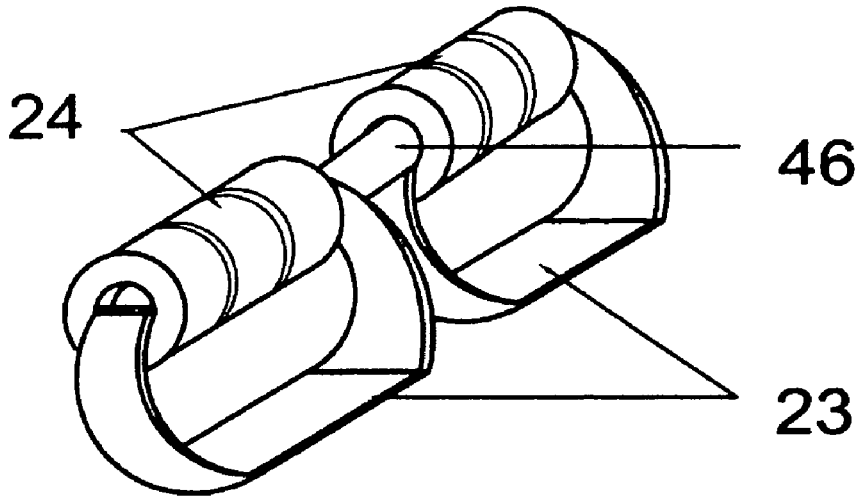

FIG. 21 is a perspective view of the foot roll pads and stirrup straps according to the first embodiment.

Figure 22:
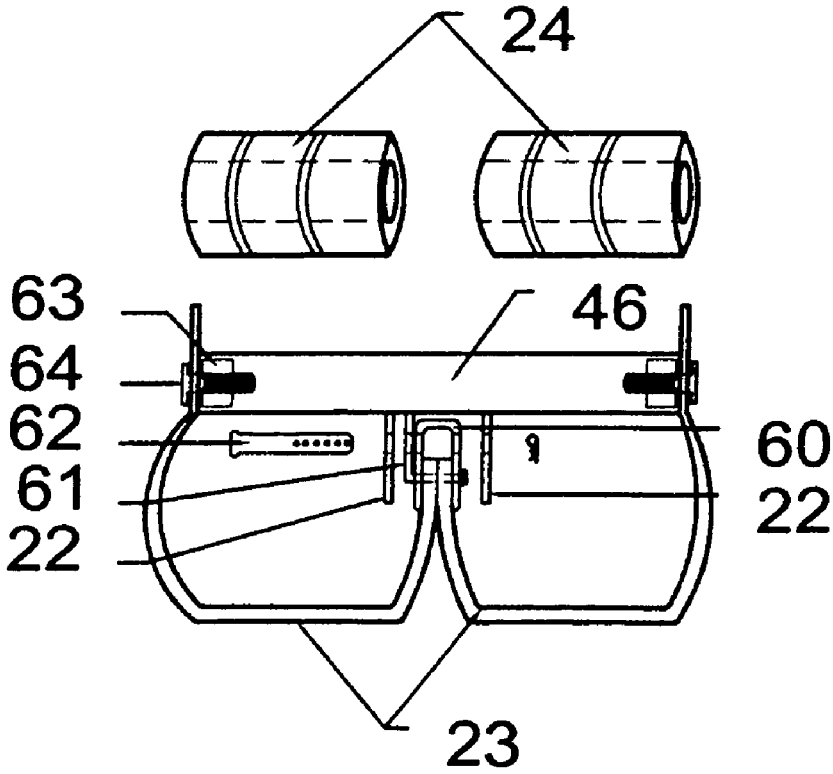

FIG. 22 is an exploded view with foot pads detached from roll bar showing roller bar and foot strip, of the first embodiment.

Figure 23:
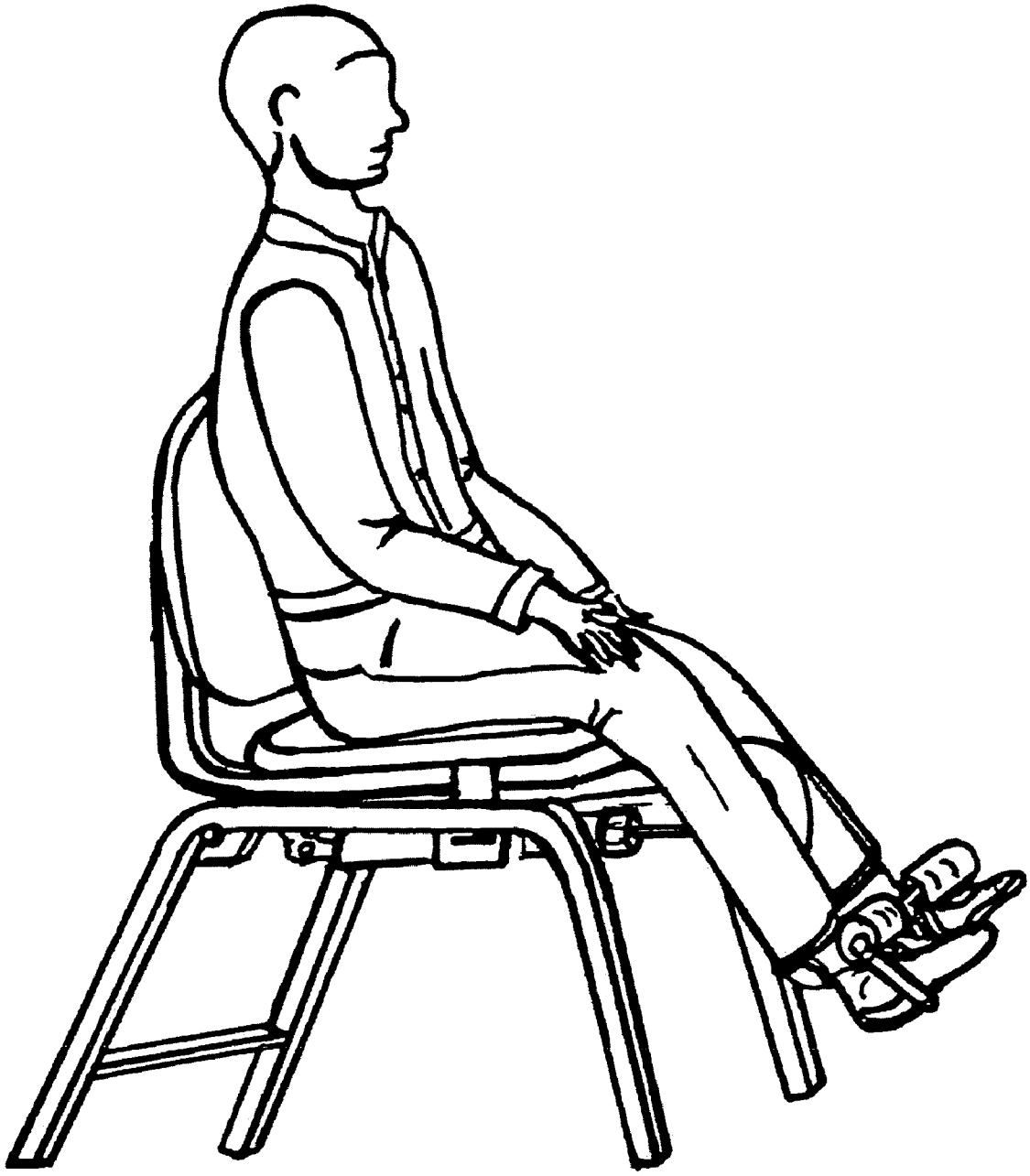

FIG. 23 is a perspective view of a user applying the ten degree chair tilt angle and leg extension apparatus in an oscillating motion in accordance with the first embodiment.

Figure 24:
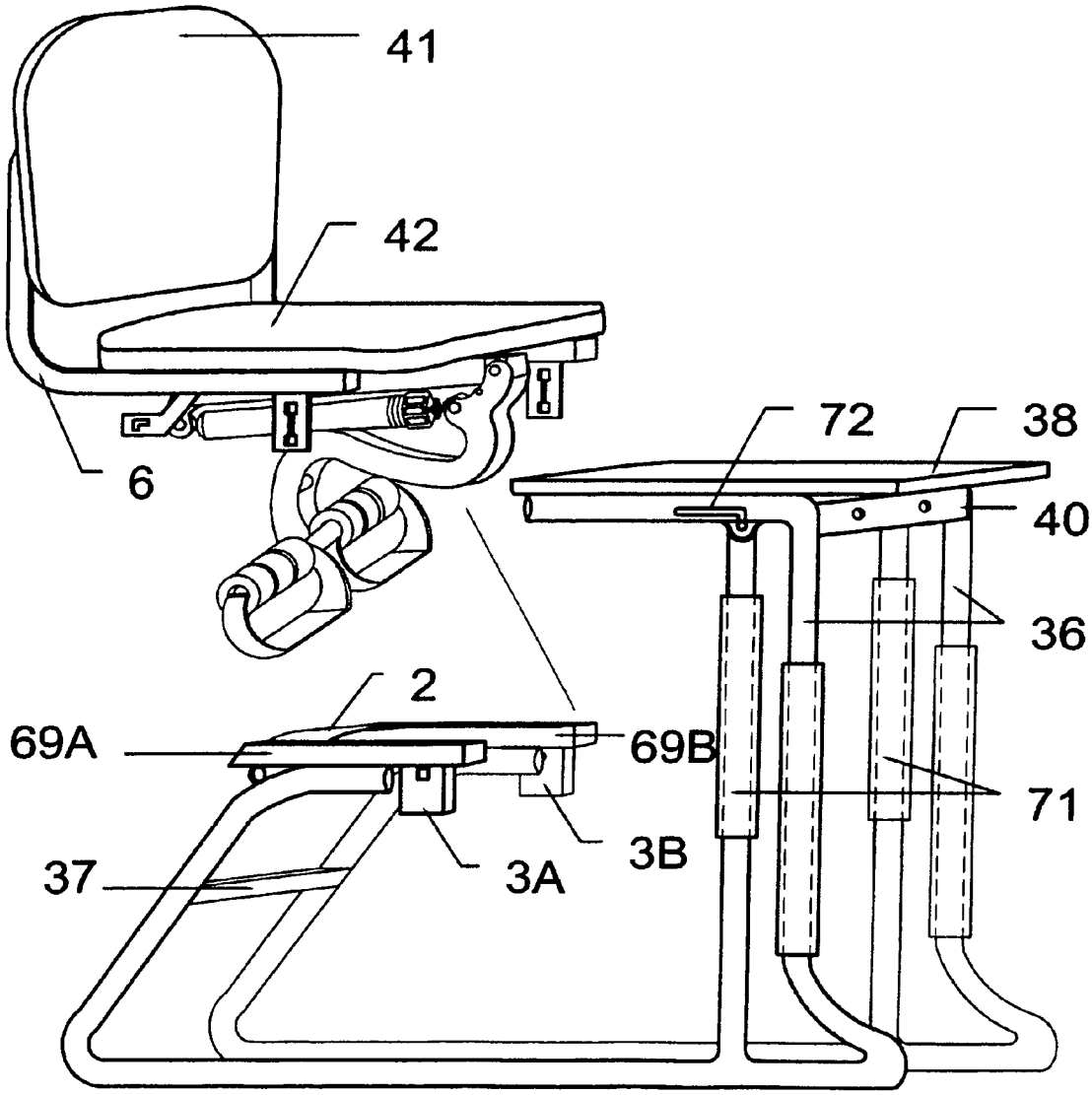

FIG. 24 is a perspective view showing another detached modification of the previous seating article with the pneumatic synergetic flexor device in the stowed position in cognition with a student school desk in accordance with the present invention.

Figure 25:
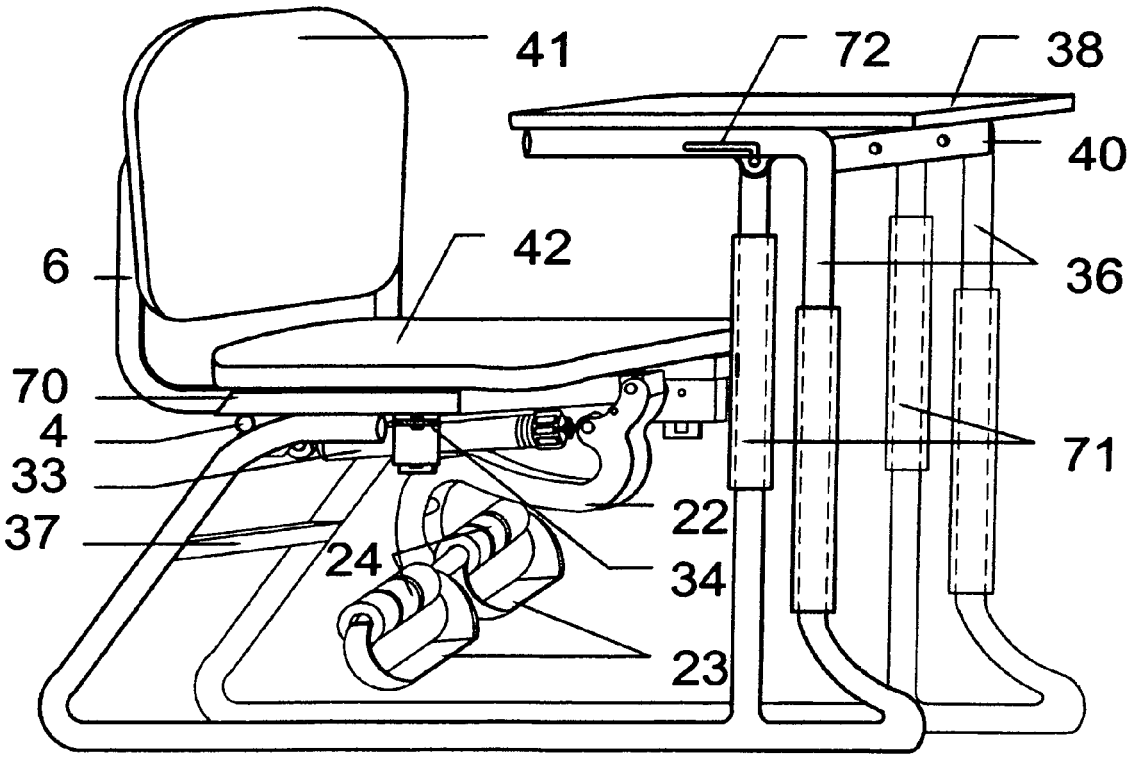

FIG. 25 is a perspective view of the seating article attached to a desk, in accordance with the second embodiment of the present invention.

Figure 26:
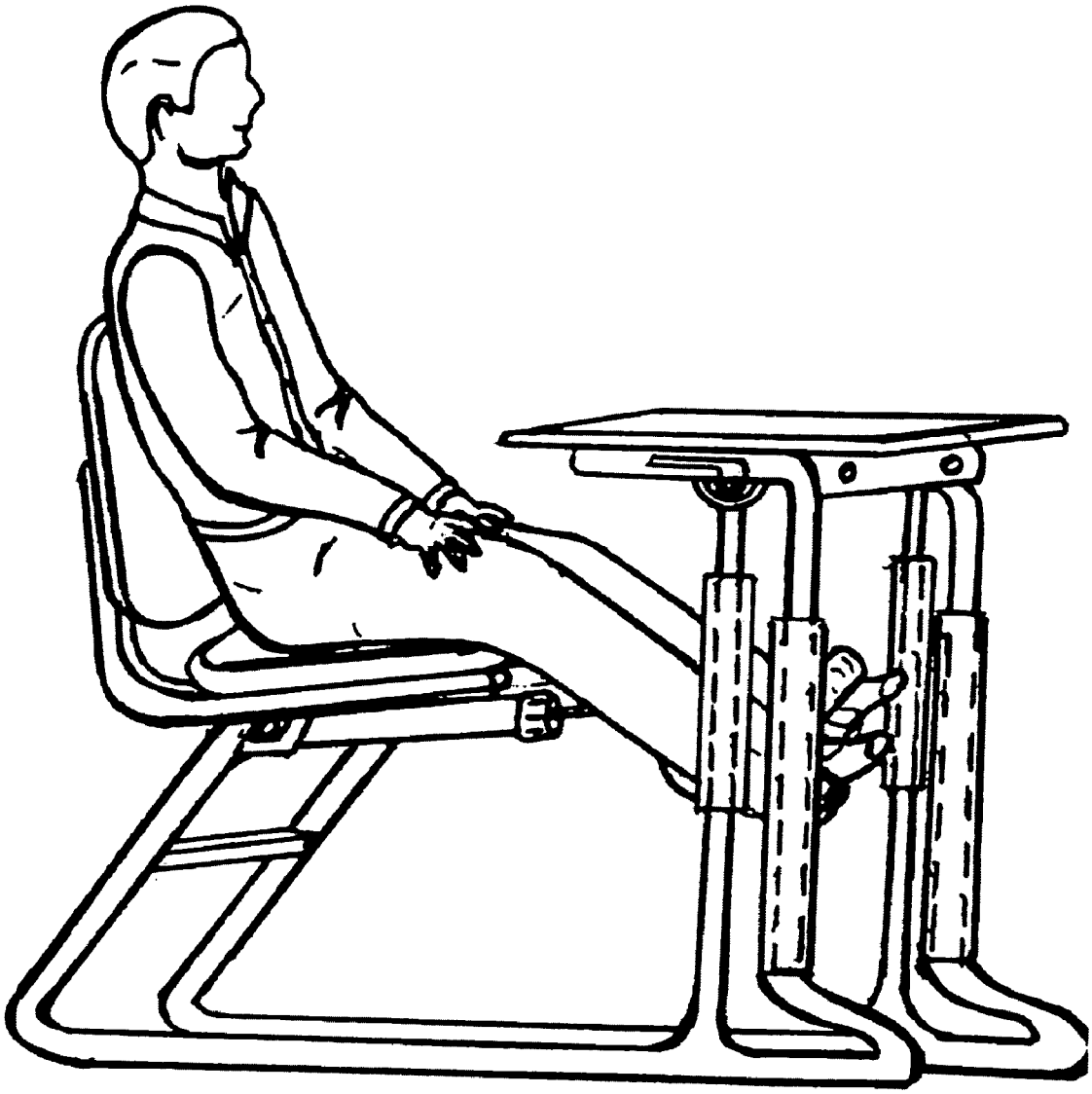

FIG. 26 is a perspective view of a user, seated at a desk while in full operation of the leg extension apparatus, in accordance with the second embodiment.

Figure 27:
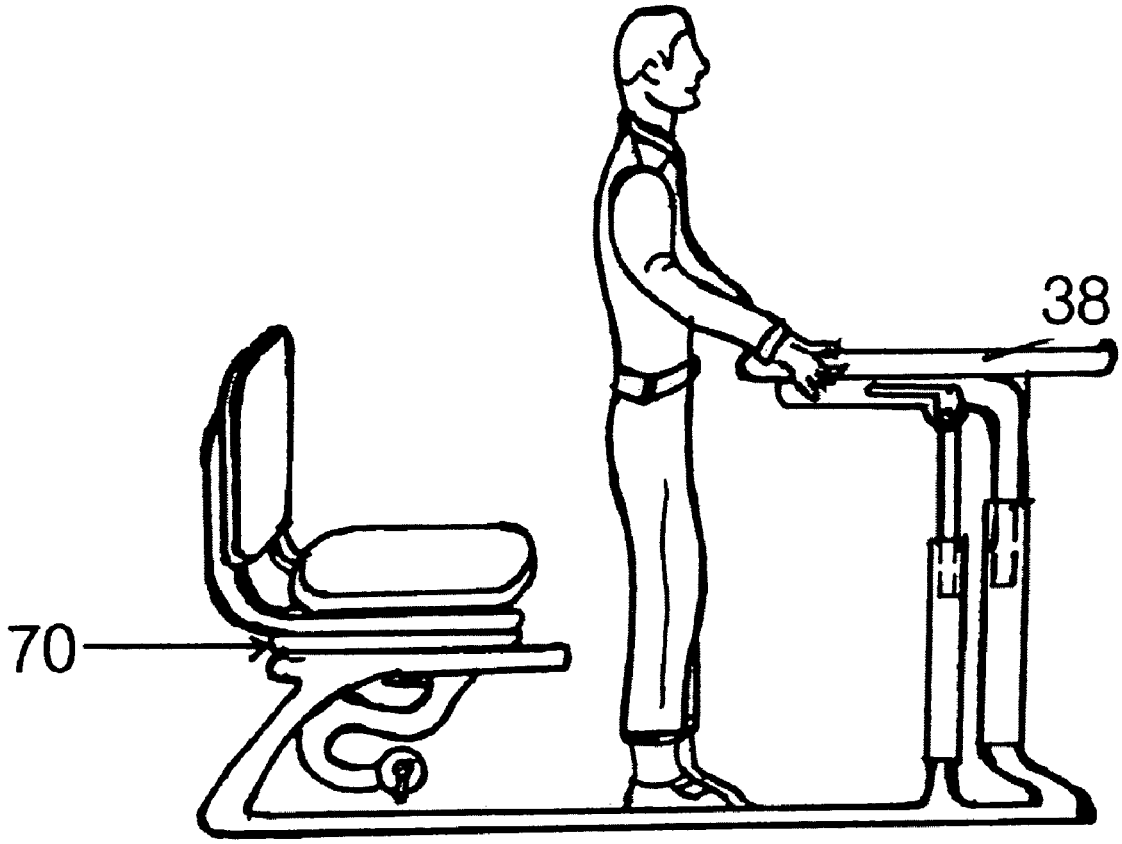

FIG. 27 is a perspective view of a user using the elevated desk platform, in an retracted position making room for the user to stand at his working desk, in accordance with the second embodiment.

Figure 28:
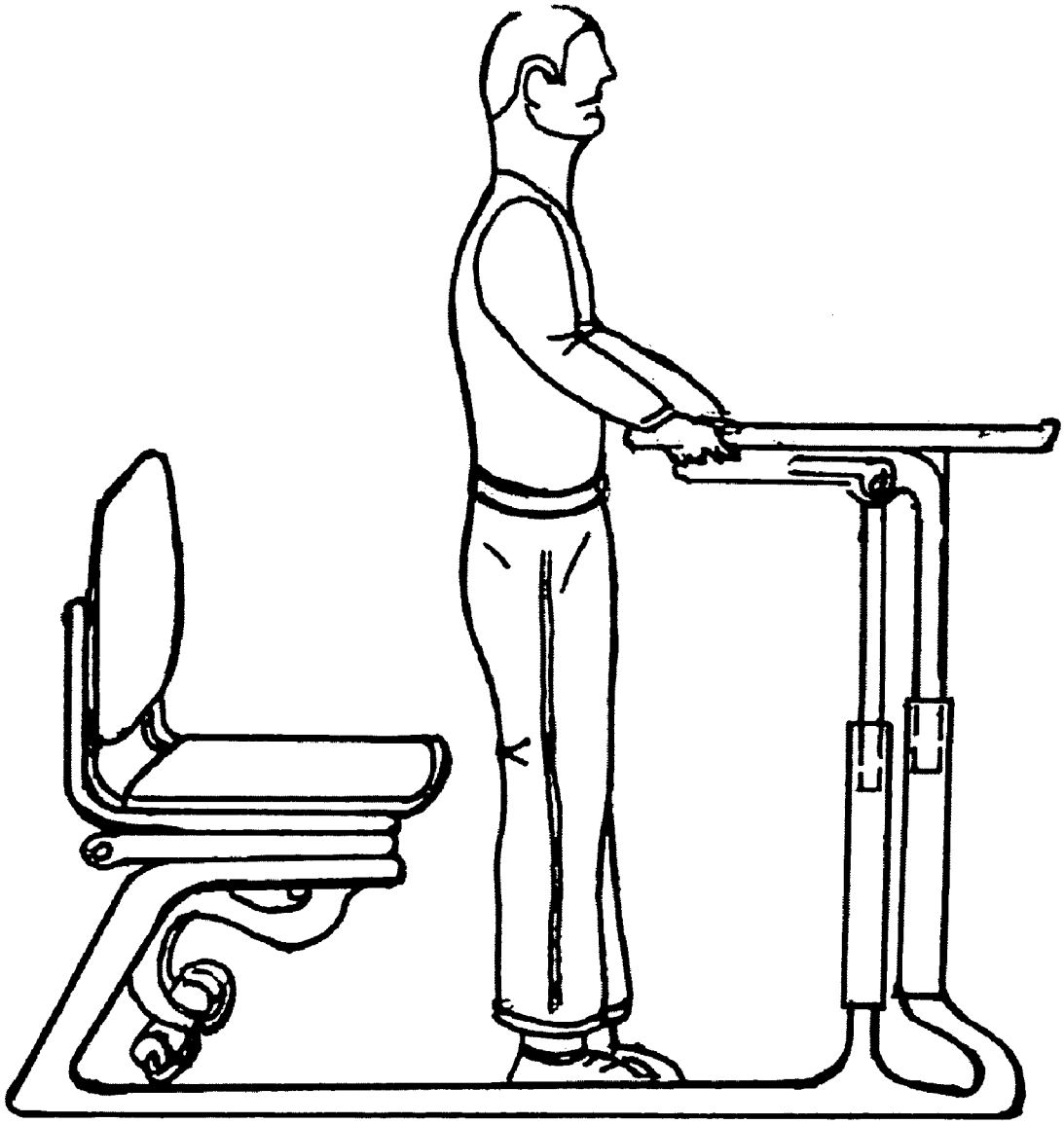

FIG. 28 is a further illustration of FIG. 27 but with an adult as opposed to child user in accordance with the second embodiment of the present invention.

Figure 29:
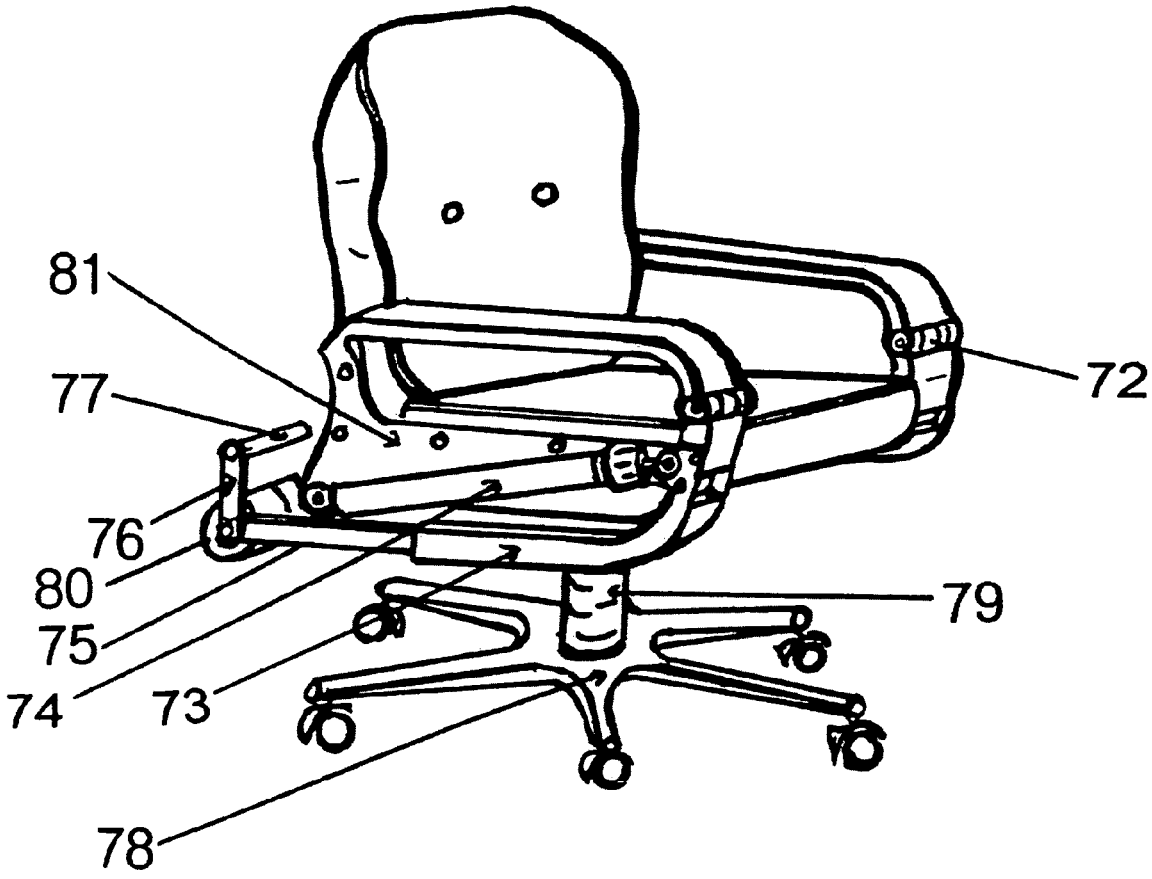

FIG. 29 is a perspective view of the third embodiment of the present invention, showing a pneumatic pedestal swivel caster based office seating article with a leg extension apparatus in the stowed position, each assembly being individually mounted under each chair arm.

Figure 30:
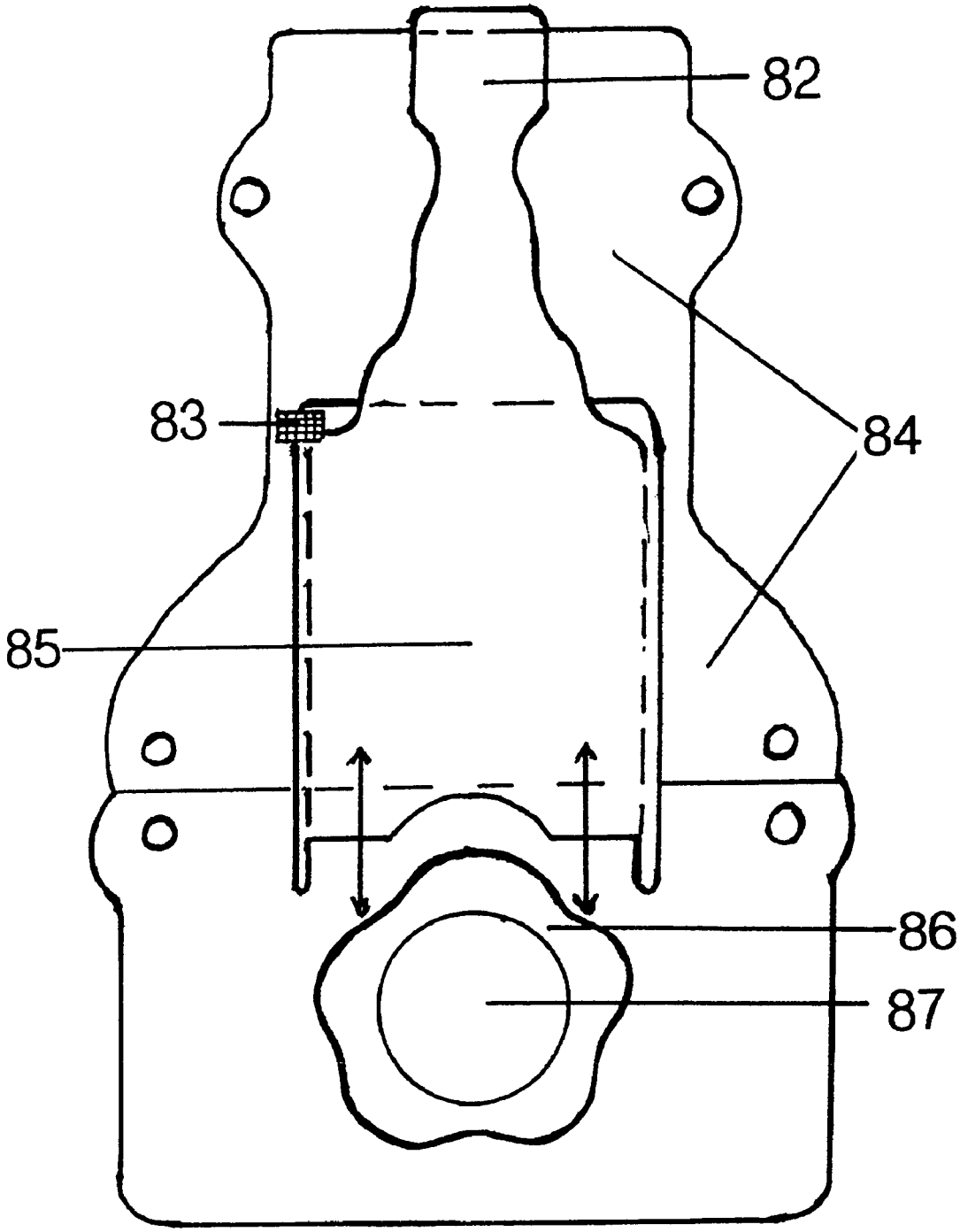

FIG. 30 is schematic bottom view of the office chair ten degree angle tilting holding block mechanism of the caster based office seating article in accordance with the present invention.

Figure 31:
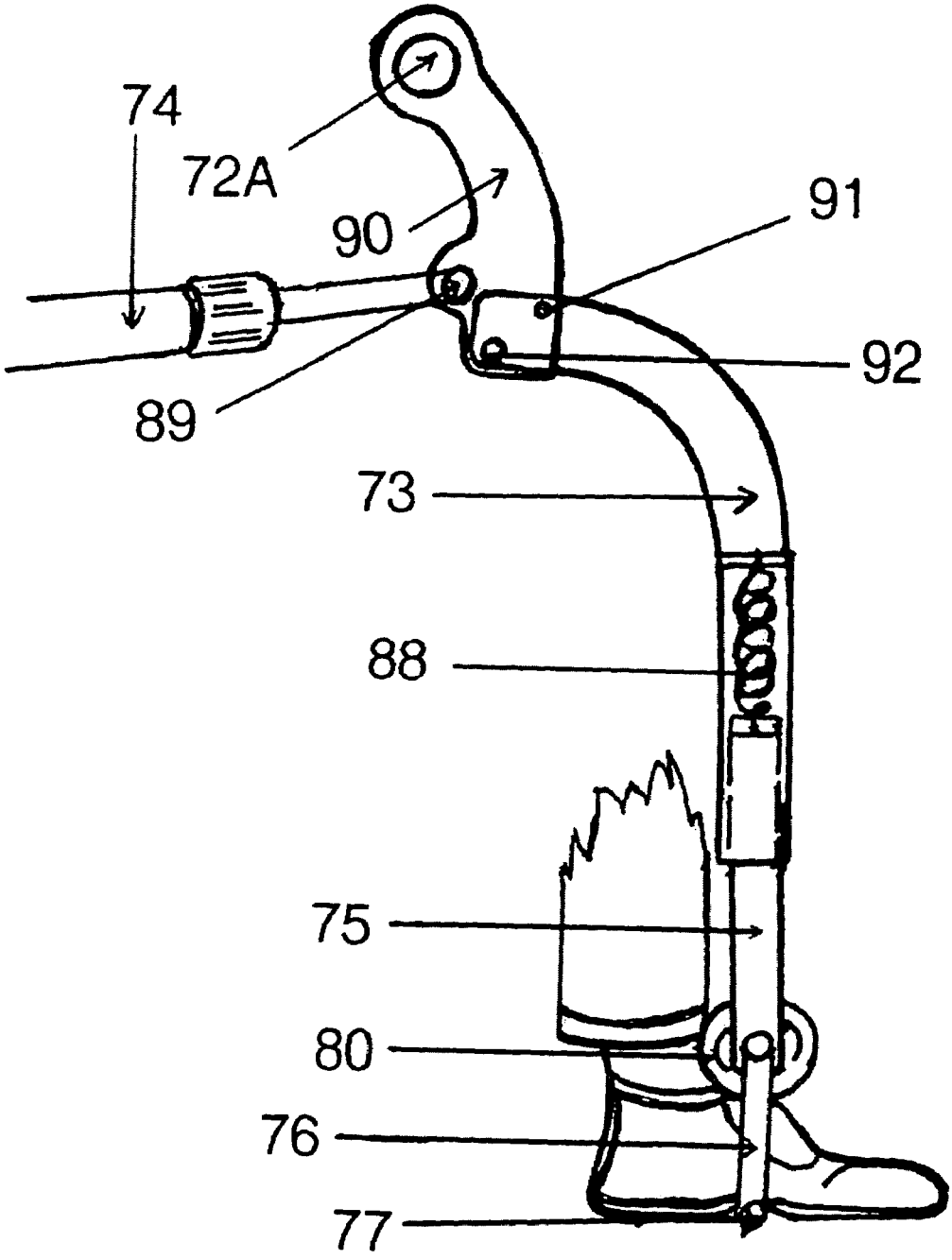

FIG. 31 is a schematic view of the flexor leg connection to the chair arm, the spring loaded lower flexor leg padded roll foot stirrup and under foot piece of the caster based office seating article, in accordance with the third embodiment.

Figure 32:
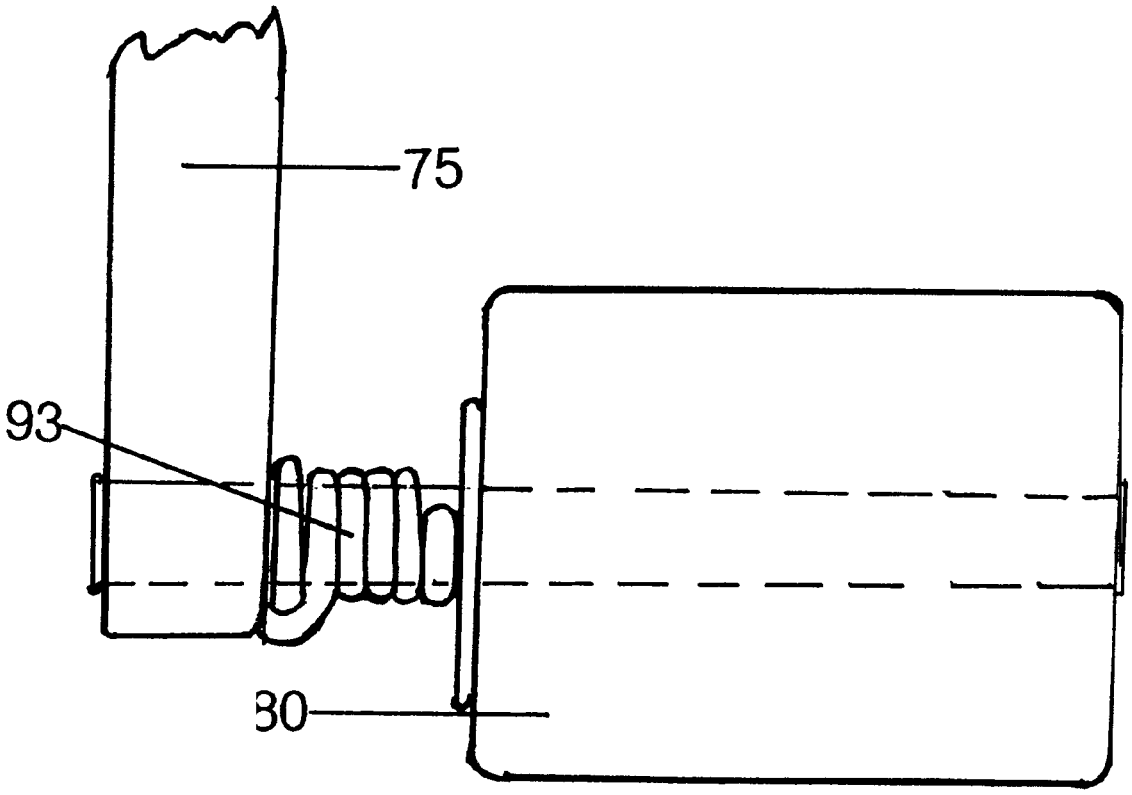

FIG. 32 is a schematic front view of the padded roll foot stirrup, showing the under foot piece collapsed due to the spring pressure to a stowed position all connected to the lower flexor leg of the caster based office seating article in accordance with the third embodiment.

Figure 33:
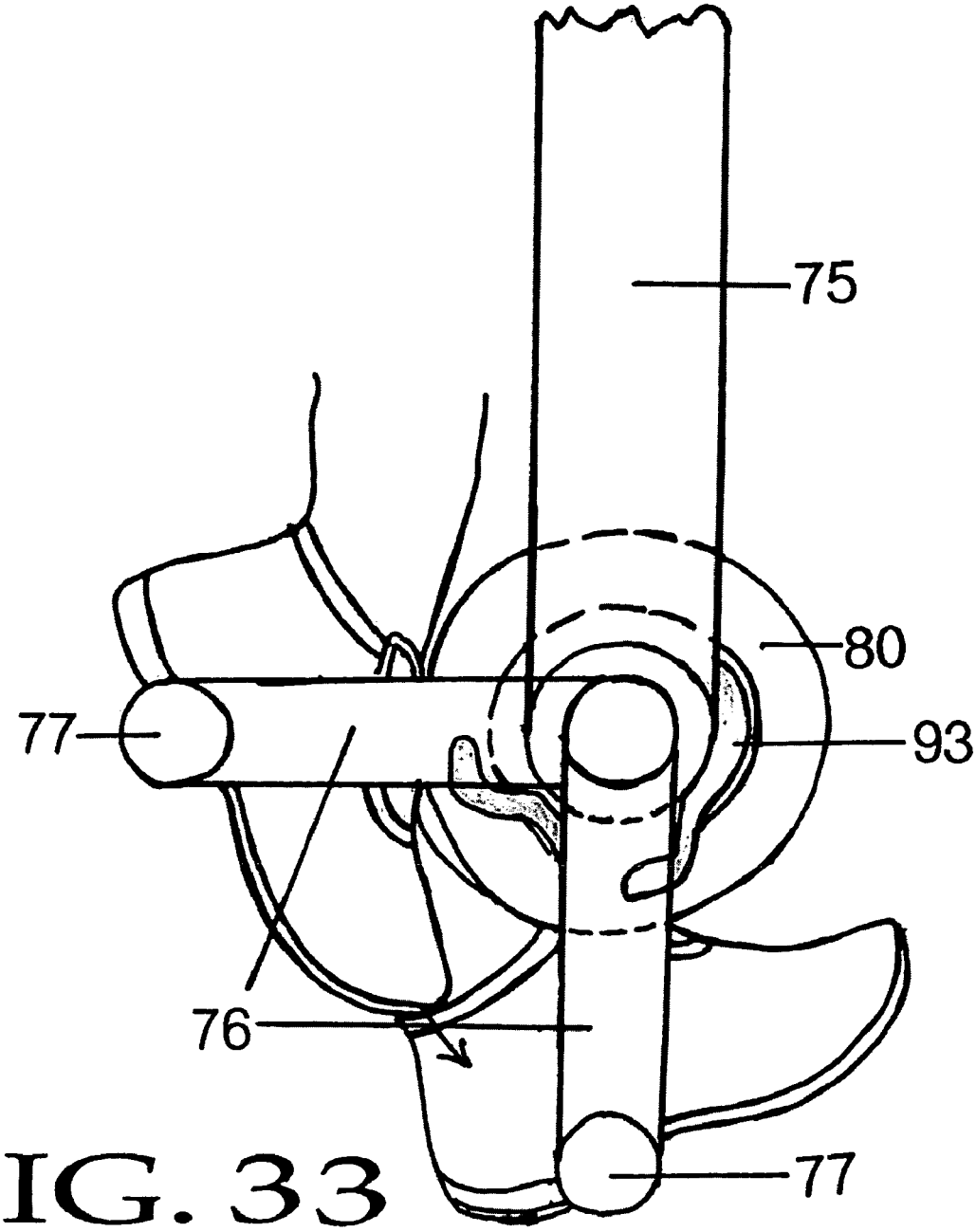

FIG. 33 is a schematic side view of a user's foot mounting the padded foot stirrup against the spring loaded under foot piece of the caster based office seating article, in accordance with the third embodiment.

Figure 34:
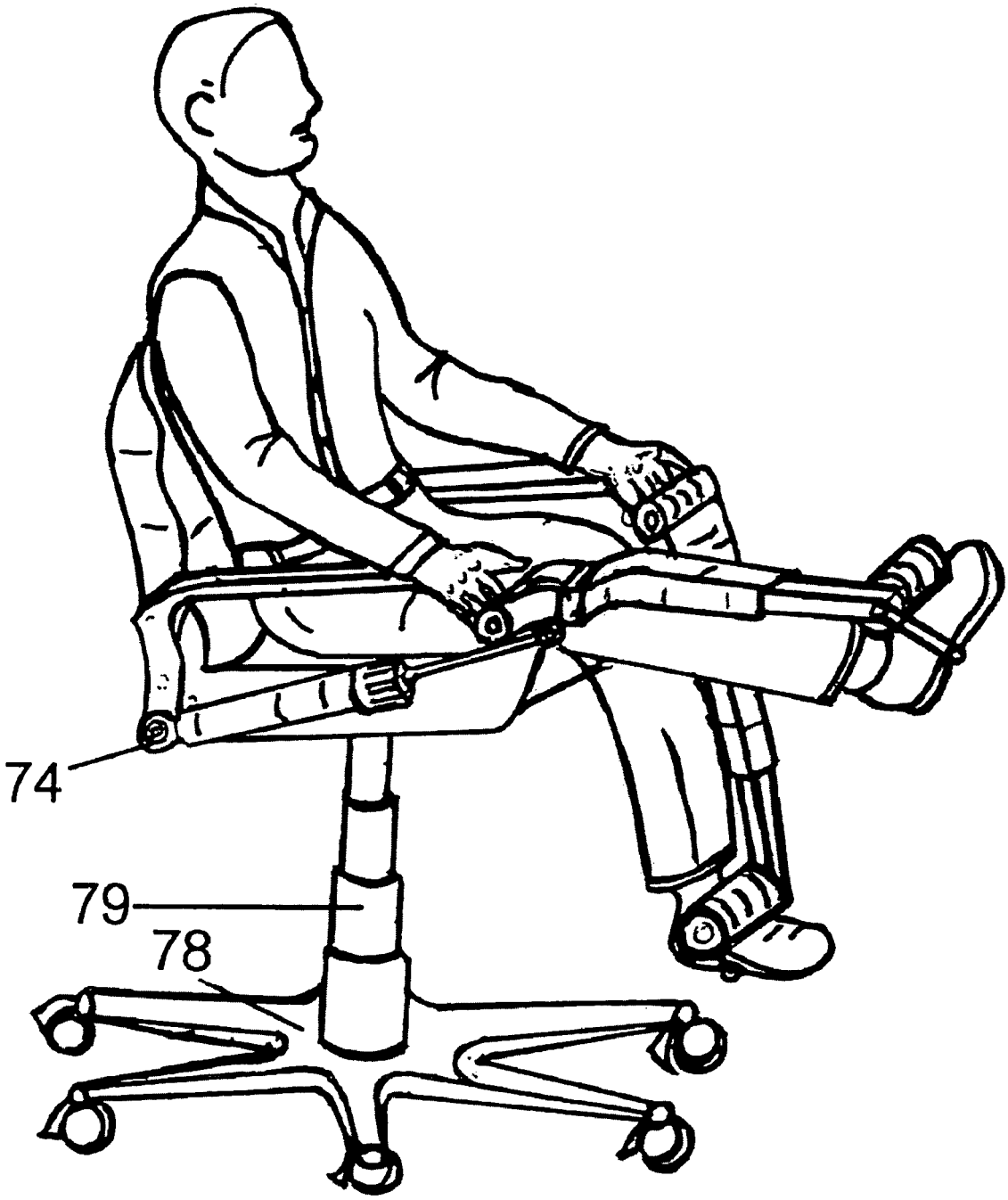

FIG. 34 is a perspective view of a user in leg oscillating motion of the leg extension apparatus on the office seating article (reclined at a ten degree angle with the pedestal understructure in an elevated position), in accordance with the third embodiment.

DESCRIPTION OF THE PREFERRED EMBODIMENTS

First Embodiment

Turning now to a detailed description of the preferred embodiments, FIG. 1 illustrates a straight back chair with reclining capabilities with a leg extension apparatus in place under the chair seat. The chair legs 1 start with the front leg at the floor extending upwards to a bend continuing across the top forming the base to a downward bend forming the rear leg to come in contact with the floor. The right legs are preferably rigidly connected to corresponding left chair legs by a web horseshoe stabilizing plate so placed to prevent leg spread, the stabilizing plate so illustrated in FIG. 3. A rear lower leg stabilizing spreader bar 35 rigidly secures the right leg to the corresponding left leg 1. A rear top roll bar 4 extends from under the top rear right leg 1, bends to the underside of the corresponding top rear left leg 1, rigidly securing the rear edge of the horseshoe web. The web is so contoured as to come in contact with the underside of the upper right leg 1, and left leg 1, and over top of the rear roll bar 4.

As shown in FIG. 2, the corresponding right and left legs are preferably firmly and non-flexibly connected to form the base frame of a chair with reclining capabilities.

FIG. 3 shows a further top view of the right leg 1, and left leg 1, rigidly connected to the horseshoe stabilizing plate 2, showing rounded rear corners exposing the top rear roll bar 4 while showing the front of web 2, openings in anchoring blocks 3*a*, and 3*b*, rigidly connected to the leg frame.

FIG. 4 shows the seat and back frame 6, rigidly connected to the cross frame 8, with under-seat tilt adjusting parts 3*aa*, and 3*bb*, rigidly connected to seat frame 6, and rear tilt up roll bar flange 7, rigidly connected to seat frame and securing pin 55. A padded or plastic or wooden one-piece chair seat 42 and back 41 may optionally be provided.

FIG. 5 illustrates the framework 8, 52, and 53, required to secure the seat and back frame in arrangement according to the first embodiment, with outer tube securing bracket 9, with slider eye bolt 16, pin 15, and bracket 10, affixed rigidly to the outer tube securing bracket 9.

FIG. 6 illustrates the leg frame 1 and seat back frame 6, in union with the top roll bar 4, housed in its position between the tilting flange 7*b*, and leg frame 1, with securing pin available, thus allowing the front of the chair seat to be safely tipped up to a reclined angle (such as 10°). Also showing bracket 11, in-housing the roll pin 19, eye bolt 21*a*, and *b*, so aligned to accept slider eye bolt 16, as shown in FIG. 5 with securing pin 20, and adjusting lever 12.

FIG. 7 is an illustration of the anchoring block insert 3*aa* with securing square holes B, and C, connected at opening D, all rigidly attached to the chair seat and back frame 6.

FIG. 8 illustrates the hollow anchoring block 3*a*, showing the anchoring pinhole A, rigidly attached to the forward chair leg frame 1, and square anchoring pin 34.

FIG. 9 shows additional details of the seat and back frame 6, in a front view.

The chair leg 1 is also shown with the anchoring insert in its place in the anchoring block. Anchoring pin 34 is shown with square shoulder E, and round shoulder F, compression spring 55, and chair seat 42.

FIG. 10 illustrates the straight back chair in the reclined tipped up position, showing lower stabilizing bar, holding block, insert block, anchoring pin, rear roll bar, rear tilt up roll bar flange, seat and back all in place.

FIGS. 11 & 12 show the leg extension apparatus, showing the flexor leg 22, shock absorber, foot stirrup 23, in a stowed position secured by the eccentrically unbalanced holding clip 65, as well as in its extended position. FIG. 12, illustrates the apparatus inner tube 18, retracted stowing the shock absorber 33, the flexor leg 22, the foot stirrup padded foot rolls 24, and return straps 23, held in the stowed position by the eccentrically unbalanced holding clip 65. Also shown are the inner square tube 18, extended, the shock absorber extended, and the flexor leg extended (with the eccentrically unbalanced holding clip released).

FIG. 13 shows the outer square tube 17, its attaching clip 28, pin 51, attaching tube 27, and pin 13 which secures the outer square tube to the seat back frame 9 (shown in FIG. 5), in its place under the seat. FIG. 13 also shows the inner and outer square tube securing pin hole 48.

FIG. 14 shows the inner square tube, and provides a partial view of the flexor leg 22 securely attached to the inner square tube. Also shown are the eccentrically unbalanced holding clip 65 and pin 66, the inner outer square tube securing pin hole, and the rear shock absorber securing bracket 50.

FIG. 15 shows a bottom view of the outer square tube 17, elongated slot 49, providing for the inner tube 18 rear shock absorber bracket 50 to extend down through the outer tube slot 49 to allow the inner square tube shock absorber bracket 50 to travel unimpeded the length of the outer tube slot 49.

FIG. 16 shows a bottom view of the inner tube 18 shock absorber bracket 50 and the eccentrically unbalanced holding clip holding slot 68.

FIG. 17 illustrates the double sided flexor leg 22, which allows for excellent stowing due to its contoured (S-shaped) configuration. In this design, the flexor leg gives the user the most comfortable leg and foot position, resembling the oscillating motion of a person's leg and foot. FIG. 17 also shows the pneumatic shock absorber connecting pin hole 32, the eccentrically unbalanced holding clip 65, and pin hole 31, the inner tube connecting holes 30*a*, spacer 25, and foot roll bar 46.

FIG. 18 shows connecting pin 30, bearing 56*a*, insert bushing 57, the double sided flexor leg 22, inner tube 18, bearing 56*b*, washer 18, and snap-ring 59.

FIG. 19 shows the pneumatic shock absorber, rear eye hole 29, the body 33, pressure adjusting control 44, plunger rod 45, and forward eye hole 32.

FIG. 20 shows the front end view of the leg frame 1, in which the seat frame 8 is resting in the common normal use position. FIG. 20 also shows the integrated under-seat mechanism in a systematic order including cross member 8, and the outer tube bracket 9. Also shown are the outer tube securing pin 13, the outer square tube 17, and inner square tubes 18, front end view, the slider eye bolt pin 16, bracket 10, spring 14, roll pin 19, and lever 12.

FIG. 21 illustrates roll bar 46, detached from the flexor leg 22, with the roll pads inserted in place on the bar, showing the foot return strap 23.

FIG. 22 illustrates the foot return straps 23 connected by the threaded inner bar 63, in relationship with the square headed male threaded bolt 64, securing the outer end of the adjustable foot strap 23. The inner end of the return foot straps 23 are secured to the lower end of the flexor leg 22 by a U shaped part 60, with elongated slotted holes on either side and a L shaped locking clip 61, anchored by aligned holes with pin 62. This allows a user's foot to be placed through the adjustable return strap 23, and under the padded foot roll.

FIG. 23 is a schematic view of a person, while in a seated position, actuating the leg extension apparatus in combination with the chair.

Second Embodiment

FIG. 24 illustrates the second embodiment, a combination chair, desk and leg extension apparatus. The embodiment allows the chair to be combined for multi-tasking in the course of seated activity. One possible use of the second embodiment is as a student's school desk. FIG. 24 shows mounting bracket 69, A & B with sliding capabilities and height-adjustable desk platform 38.

FIG. 25 is a further illustration of the second embodiment, with the desk top 38, which is preferably rigidly secured and mounted on frame 40, having four telescoping legs 36, at least two of which are pneumatically adjustable 71. As shown, release lever 72 allows the pneumatic height adjustment. In a generally U-shaped frame, the legs 36, extend from the desk top frame 40, take a 90% turn to a vertical, continuing from the desk frame to the contour of the floor part of the frame, where they join the pneumatic shock absorber telescoping legs 71, then continue on to the rear contour up to the stabilizer spacer 37, where the legs meet the base of the seat under seat frame 36.

FIG. 26 illustrates a user operating the leg extension apparatus, with the chair reclined to approximately 10°, for smooth oscillation in an arc forward and back. It will be noted that the reclined angle of the chair contributes to the clearance between the floor and apparatus.

FIGS. 27 and 28 illustrate the second embodiment using the under seat slider mechanism 70, in its rear position allowing room to stand at the desk, while the desk platform 38, is in a elevated position to accommodate taller users.

Third Embodiment

FIG. 29 illustrates a schematic view of a third embodiment. In combination with an office chair, a variation of the leg extension apparatus is illustrated in its stowed position, connected to the chair by the use of the arm frame 81. Right and left arms are preferably rigidly connected together by two cross members one under the forward seat part and one to the back supporting of the chair back. The arms are interrupted just below their downward bending contour by an bearing hinge 72, which allows the leg extension apparatus to pivot in an oscillating motion when the flexor leg parts 73, 75, 76, 77, and 80, are in operational mode.

The chair preferably has a pneumatic height adjustment 79 to vary the distance between the seat portion and the base 78 (shown here with casters).

FIG. 30 is a view of the underseat tilt holding block mechanism 85, and finger operated handle 82, which, when activated, will maintain the office chair in a 10° tilted angle. When the chair seat is physically held in a tipped up position the hold block 85, is released from its holding clip 83. The hold block is then slid in a rearward direction until it wedges under the adjusting handle 86, contacting the adjusting handle post 87, holding the chair seat at the selected tilt angle.

FIG. 31 shows the flexor leg 73, 75, in a swung down position from its stowed position on pin 92. The flexor leg is held in position by pin 91, rigidly connecting it to the lower chair arm 90, where it can be propelled by the use of the bearing hinge 72, in an oscillating arc forward and back leg foot movement, with pressure regulated by the pneumatic shock absorber 74 (a two-way resistant pneumatic cylinder and piston), the lower flexor leg inner tube 75, being held in position by spring 88, secured to both outer tube and inner tube with pins, thus allowing for difference in leg length during operations with the foot strip padded roll 80, and under foot bar 77.

FIG. 32 illustrates the foot end of the flexor leg 75, padded roll 80, and center pin connection with the flexor leg 75, strategically spaced to allow a roll compression spring to exist between the flexor leg and the padded foot roller, holding the under foot bar in an up and out off the way position when flexor leg 73, 75, is not in use.

FIG. 33 illustrates a side view of the foot end of the flexor leg 75, showing a user's foot being wedged between the under foot bar 77, and padded foot roller 80, thereby applying force against the roll compression spring held in place by the connecting bar 76, thus leaving the foot to come into a comfortable position in the foot strip.

FIG. 34 shows the seated article at a 10° tilt, with both the pneumatic under seat pedestal 79 and the pneumatic shock absorber 74 extended, with the user actuating the leg extension apparatus.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What is claimed is:

1. A combination chair and leg extension apparatus, comprising:

a chair having a generally L-shaped frame on which is disposed a seat portion and a back portion, and a base portion having legs extending below the frame to the floor, the seat portion having a top surface for sitting and a bottom surface opposed to the top surface, a tilt up means disposed between the frame and the base portion to permit selective pivoting of the frame into a position in which a front edge of the frame is spaced away from the base, a leg extension apparatus attached to the chair, the apparatus comprising:

a telescoping tube member mounted in a longitudinal orientation on the bottom surface of the seat portion, the tube having at least two segments concentrically arranged for telescopic movement in relation to each other, the tube having a front end disposed toward the front of the chair and a back end disposed toward the back of the chair, a flexor leg pivotally mounted to the front end of the tube and terminating in a pair of foot stirrups, and a pneumatic resistor connecting the flexor leg to the back end of the tube, the apparatus permitting a user seated in the chair to engage the stirrups with the user's feet and, using the force of the user's leg strength to overcome the resistence provided by the resistor, to kick the flexor leg from a position below the seat portion forward in an arc, thereby drawing forward the tube to fully extend the flexor leg and the tube forwardly away from the chair, wherein the tilt up means, when tilted up, provides clearance for the flexor leg and the user's feet to sweep below the seat portion without touching the floor, and when not tilted, allows the chair to be used in the manner of a standard chair wherein the user's feet touch the floor.

2. The combination chair and leg extension apparatus of claim 1, wherein the arc described by the stirrup end of the flexor leg does not touch the floor at any point.

3. The combination chair and leg extension apparatus of claim 1, wherein the arc described by the stirrup end of the flexor leg does not touch any portion of the chair.

4. The combination chair and leg extension apparatus of claim 1, wherein the tilt up means provides clearance between the flexor leg and the floor.

5. The combination chair and leg extension apparatus of claim 1, wherein the apparatus has a stowed position wherein the flexor leg is positioned under the frame of the chair and the tube is in a retracted state, and wherein the apparatus in the stowed position does not extend in any direction beyond the outer dimensions of the chair.

6. The combination chair and leg extension apparatus of claim 1, wherein the apparatus has a stowed position wherein the flexor leg is positioned under the frame of the chair and the tube is in a retracted state, and wherein the apparatus in the stowed position does not extend in any direction outside an area bounded by the legs of the chair.

7. The combination chair and leg extension apparatus of claim 1, wherein the flexor leg comprises a generally S-shaped member.

8. A combination desk, chair and leg extension apparatus, comprising:

a combination desk and chair having a generally U-shaped frame on which is disposed at one end a desk platform, and at the other end a chair, the chair having a generally L-shaped frame on which is disposed a seat portion and a back portion, and a base portion connected to the U-shaped frame, the seat portion having a top surface for sitting and a bottom surface opposed to the top surface, a leg extension apparatus attached to the chair, the apparatus comprising:

a telescoping tube member mounted in a longitudinal orientation on the bottom surface of the seat portion, the tube having at least two segments concentrically arranged for telescopic movement in relation to each other, the tube having a front end disposed toward the front of the chair and a back end disposed toward the back of the chair, a flexor leg pivotally mounted to the front end of the tube and terminating in a pair of foot stirrups, a pneumatic resistor connecting the flexor leg to the back end of the tube, the apparatus permitting a user seated in the chair to engage the stirrups with the user's feet and, using the force of the user's leg strength to overcome the resistence provided by the resistor, to kick the flexor leg forward in an arc, thereby drawing forward the tube to fully extend the flexor leg and tube forwardly away from the chair.

9. The combination desk, chair and leg extension apparatus of claim 8, wherein the desk platform is adjustable to raise or lower the height.

10. The combination desk, chair and leg extension apparatus of claim 8, wherein the U-shaped frame is adjustable to vary the space between the chair and the desk to provide clearance for the extension of the leg extension apparatus when in use.

11. A combination office chair and leg extension apparatus, comprising:

an office chair having a generally L-shaped frame on which is disposed a seat portion a back portion and two arm rests, and a pedestal base portion extending below the frame to the floor, the pedestal base portion being height adjustable to selectively vary the distance between the frame and the floor, a leg extension apparatus having two leg extension assemblies, each assembly attached to an arm rest of the chair and comprising:

a flexor leg pivotally mounted to the arm rest;

a telescoping tube member connected to and extending beyond the flexor leg, the tube having at least two segments concentrically arranged for telescopic movement in relation to each other, and terminating in a pair of foot stirrups, and a pneumatic resistor connecting the flexor leg to a back end of the arm rest, the apparatus permitting a user seated in the chair to pivot forward the apparatus from the stowed position and to engage the stirrups with the user's feet and, using the force of the user's leg strength to overcome the resistence provided by the resistor, to kick the flexor leg forward in an arc, thereby drawing forward the tube to fully extend the flexor leg and tube forwardly away from the chair, wherein the pedestal base portion can be raised to provide clearance for the flexor legs and the user's feet to sweep below the seat portion without touching the floor, and can be lowered to allow the chair to be used in the manner of a standard chair wherein the user's feet touch the floor.

12. The combination office chair and leg extension apparatus of claim 11, wherein the office chair further comprises a tilt up means disposed between the frame and the base portion to permit selective pivoting of the frame into a position in which a front edge of the frame is spaced away from the base.

13. The combination office chair and leg extension apparatus of claim 11, wherein the height adjustable pedestal base permits clearance between the arc described by the apparatus and the floor.

14. The combination office chair and leg extension apparatus of claim 11, wherein the apparatus does not touch the floor at any point.

15. The combination office chair and leg extension apparatus of claim 11, wherein the apparatus does not touch the pedestal base at any point.

16. The combination chair and leg extension apparatus of claim 1, further comprising a desk.

17. The combination office chair and leg extension apparatus of claim 11, further comprising a desk.

* * * * *